US006217143B1

(12) United States Patent
Munakata et al.

(10) Patent No.: US 6,217,143 B1
(45) Date of Patent: Apr. 17, 2001

(54) METHOD OF PRINTING USING SCANNING PRINT HEAD AND APPARATUS USING SAME

(75) Inventors: Atsushi Munakata, Yokohama; Hideaki Takada, Kawasaki, both of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 08/782,299

(22) Filed: Jan. 15, 1997

(30) Foreign Application Priority Data

Jan. 17, 1996 (JP) ..... 8-005855

(51) Int. Cl.[7] ..... B41J 29/38

(52) U.S. Cl. ..... 347/16; 347/37; 347/40; 400/279; 400/283

(58) Field of Search ..... 347/37, 16, 104, 347/40, 41; 400/279, 283

(56) References Cited

U.S. PATENT DOCUMENTS 4,686,540 * 8/1987 Leslie et al. ..... 346/33 R
4,972,270 * 11/1990 Kurtin et al. ..... 358/296
4,975,780 * 12/1990 Kuboki ..... 358/296
5,910,811 * 6/1999 Sato ..... 347/104

* cited by examiner

*Primary Examiner*—John Barlow
*Assistant Examiner*—Craig A. Hallacher
(74) *Attorney, Agent, or Firm*—Fitzpatrick, Cella, Harper & Scinto

(57) ABSTRACT

A method of printing in which, when an image is divided to be printed into a plurality of lines, the feeding amount of a printing medium is equalized in each line for eliminating a feeding error of the printing medium to print a high-quality image. The image to be printed in a top line of the printing medium is formed into a printable image by ink ejection ports located at an upstream side with respect to a printing medium feeding direction of a print head, and a width of the image printed in the top line is an adjusting width for unifying the width of image printed in other lines to a specified width according to the print head.

20 Claims, 20 Drawing Sheets

METHOD OF PRINTING USING SCANNING PRINT HEAD AND APPARATUS USING SAME

BACKGROUND OF THE INVENTION

1. Field of the Invention

The present invention relates to a printing method and printing apparatus in which a print head is scanned in a direction transverse to the feeding direction of a printing medium to achieve printing of an image line by line.

2. Description of the Related Art

Heretofore, printing apparatuses using various image formation means have been practically used, and among these, an ink-jet type is relatively inexpensive, compact in structure, low in noise, and being used in a variety of applications from personal to office use.

As a method of image formation in a printing apparatus, a serial scan system has been generally known. In the serial scan system, while the print head is being reciprocally scanned, the printing medium is fed in a direction perpendicular to the scanning direction of the print head, intermittently in an amount equal to the printing width of one scan, to sequentially form the image line by line.

The serial scan system is also widely applied in the area of ink-jet type recording apparatus.

Heretofore, the ink-jet type printing apparatus has been disadvantageous in that the image formation speed is slower as compared with an electrophotographic type. However, recently, with improved integration ink ejection ports of the print head, some of print heads having 512 ink ejection ports arranged in a recording density of 400 dpi (dot per inch) have been practically applied, which achieves an image formation speed comparable to the electrophotographic system.

However, when an image is formed by serial scanning, it is necessary that the printing medium is fed exactly in a predetermined amount in order to obtain an image of good quality. To realize such feeding, a feeding unit of the printing medium is normally composed of a roller pair disposed at the upstream side or downstream side with respect to the feeding direction in the vicinity of the print portion of the printing medium, a drive source to drive the roller pair, drive transmission means for transmitting the driving force from the drive source to the roller pair, and the like. As the drive source, a pulse motor which can easily control the feeding amount of the printing medium is generally used, and as the drive transmission means, a pulley and rubber belt or the like is generally used.

However, if the feeding amount of the printing medium becomes in is shortened even slightly, image overlapping (black stripes) will occur, or if the feeding amount is excessive, image discontinuity (white stripes) will occur. Such error in the feeding amount becomes visually notable when occurring even in an amount of about a half picture element (about 30 $\mu$m) for a 400 DPI image, which considerably degrades the image quality. Causes of the error include machining precision of the feeding roller and driver pulley for feeding the printing medium, stopping precision of the drive source, and machining precision of the teeth of belt or pulley; in particular, error due to an eccentricity of the feeding roller and drive pulley on the feeding roller shaft is important.

To reduce the effect of the eccentricity, it is best that the circumferential length of the feeding roller is made equal to the printing width of one scan. That is, for a print head of 400 dpi, 512 ink ejection ports, since the printing width of one scan is 32.512 ink ejection ports, effect of eccentricity between the feeding roller and the drive pulley which is linked to the shaft thereof can be almost eliminated when a roller is used as the feeding roller which satisfies the requirement that its diameter of 10.349 mm corresponds to the circumferential length. In this case, when a reduction ratio between the feeding roller and the drive pulley on the same shaft is set to an integer, vibration of the drive pulley due to the motor and feeding errors generated from the stopping precision of the motor itself can be almost eliminated, and a practically sufficient feeding precision can be realized where the printing medium is fed in an amount equal to the printing width of one scan of the print head.

However, if the printing medium feeding amount is set always to a constant value, depending on the size of the printing medium, a large blank may occur at the rear end of the image, the blank amount may differ with different sizes of the printing medium. Then, in a printing apparatus which can handle different sizes of the printing medium, one of a plurality of printing movments to one printing medium is printed in a smaller printing width than usual to adjust the length of the blank.

Feeding during the one printing movement is referred to as a fractional feeding, the length of which can be calculated as a remainder of the integer portion of $\{(L-a-b)/X\}$, herein X is a printing width by a normal one scan of the print head, L is a total length of the printing medium in the feeding direction, a is a front blank, and b is a rear end blank. For example, when printing is made on a printing medium of A4 size which is fed along a longitudinal direction thereof, that is, 297 mm in total length, by an apparatus with a print head of 400 dpi, 512 ink ejection ports, that is, a normal printing width X by one scan of 32.512 mm, a front blank a of 2 mm, and a rear end blank b of 10 mm, the number of printing movements is 9, of which one movement may be made in a fractional printing (hereinafter referred to as fractional recording) with a printing width of 24.904 mm which is smaller than usual.

With the above fractional recording, image blank on the printing medium can always be made to a constant size irrespective of the size of the printing medium, but if the fractional recording is made at the top print line (hereinafter referred to as top line) at the downstream side with respect to the feeding direction or an intermediate print line (hereinafter referred to as intermediate line), it becomes necessary to feed the printing medium by a distance equal to the width of the fractional recording. Feeding of the printing medium according to the position where the fractional recording is made will be described with reference to the accompanying drawings.

(A) When fractional recording is made in the top line using the ink ejection ports at the downstream side of the print head In FIG. 16A, a printing medium P fed from the right side in the direction of arrow C stops at the position where the leading end thereof advances by 2 mm blank from the print area (hatched area in FIG. 16A). A print head 51 makes fractional recording using 392 ink ejection ports at the downstream side with respect to the feeding direction of the printing medium P corresponding to the 24.904 mm fraction. After completion of the fractional recording, the printing medium P is fed in the direction of arrow C in FIG. 16B by the fraction equal to the present printing width. Thereafter, printing using all ink ejection ports of the print head 51 and feeding of the printing medium P by the distance of the entire ink ejection ports width are repeated to achieve printing. The numeral 52 indicates a feeding roller.

(B) When fractional recording is made in the intermediate line using the ink ejection ports at the downstream side of the print head Until fractional recording is made, printing of the entire ink ejection ports width and feeding of the printing medium P of the entire ink ejection ports width are repeated. During fractional recording, first, after making fractional recording using the ink ejection ports for the fraction at the downstream side of the print head, the printing medium P is fed in an amount equal to the fractional recording amount. Thereafter, printing using all the ink ejection ports and feeding of the printing medium P of the entire ink ejection ports width are repeated.

(C) When fractional recording is made in an intermediate line using the ink ejection ports at the upstream side of the print head As shown in FIG. 17A, after completion of printing of a line immediately before the fractional recording is made, as shown in FIG. 17B, the printing medium P is fed in an amount equal to the width of fractional recording to be made next. Then, after making fractional recording using the ink ejection ports for the fraction at the upstream side of the head, the printing medium P is fed in an amount equal to the entire ink ejection ports width. Thereafter, printing using all the ink ejection ports and feeding of the printing medium P of the entire ink ejection ports width are repeated.

(D) When fractiontial recording is made in the last line using the ink ejection ports at the upstream side of the print head After printing using all the ink ejection ports and feeding of the printing medium P of the entire ink ejection ports width are repeated, for only before fractional recording of the last line, the printing medium P is fed in an amount of the fractional recording width. Then, the fractional recording is made using the ink ejection ports for the fraction at the upstream side of the print head 51. Since this is the last printing line, thereafter the printing medium P is fed to the downstream side to complete printing.

In all of the above described examples (A) to (D), the printing medium P is fed once in an amount of the fractional recording width. However, in feeding, eccentricity of the drive pulley and the feeding roller 52 is not offset. For example, as shown in FIG. 18, when the fractional recording width is about 16 mm which is a half circumferential length of the feeding roller 52, if the feeding roller 52 with a diameter of about 10 mm has an eccentricity of only 10 $\mu$m, in the worst case, a feeding error of ±20 $\mu$m will occur. Since the eccentricity occurs also in the drive pulley, precision in feeding of the fractional recording width is considerably deteriorated as compared with normal feeding.

Methods which do not make feeding of the fractional recording width include the following.

(E) When fractional recording is made in the last line using the ink ejection ports at the downstream side of the print head In the feeding methods in the above-described examples (A) to (D), as Shown in FIG. 19, where M is a distance between the feeding roller 52 and the upstream end of the printing area, the distance M is a minimum rear end blank that occurs in the printing medium P. In the present example, to maintain the rear end blank at the same length M, as in FIG. 20, fractional recording must be made after the rear end of the printing medium P is passed through the feeding roller 52. For this purpose, in order to make fractional recording of the last line while the printing medium P is pinched by the feeding roller 52, the blank at the rear end of the printing medium must be increased by one line of the printing width, and, as a result, there occurs a problem in that the effective image printing area in the printing medium P is substantially reduced.

As shown in FIG. 21, when a feeding roller 53 is disposed also at the downstream side of the printing unit, rear end blank of the printing medium P can be reduced. However, even with this arrangement, during feeding of the printing medium P before printing the last line, the rear end of the printing medium P comes out of the feeding roller 52 at the upstream side. Therefore, a feeding precision of the printing medium P in the specific case depends on the feeding roller 53 at the downstream side of the printing unit In the case of an ink-jet printing system, the printing medium P at the downstream side undergoes elongation due to the ink with time as compared with the printing area in it. The elongation amount greatly depends on the sheeting direction of the printing medium P, the amount of ejected ink (image density), and the type of printing medium P, for example, an elongation of 0.1% (30 $\mu$m) of the printing width occurs when the printing medium P is a coated paper with small elongation, and an elongation of 1% (300 $\mu$m) of the printing width occurs in ordinary paper.

With such an elongated printing medium P, even when the feeding roller 53 at the downstream side of the printing unit is rotated by a predetermined amount, the actual moving amount of the printing medium P is reduced by the elongation amount. That is, when fractional recording is made with the rear end of the printing medium P not pinched by the upstream side feeding roller 52, a feeding error of a maxim of 300 $\mu$m will occur. Furthermore, since the error itself varies with the type of printing medium P and the printing density, it cannot be corrected.

The above description can be summarized as follows.

(A) Fractional recording in the top line using the ink ejection ports at the downstream side of the head: deterioration of precision in feeding of the printing medium for fractional recording.

(B) Fractional recording in an intermediate line using the ink ejection ports at the upstream side of the head: deterioration of precision in feeding of the printing medium for fractional recording.

(C) Fractional recording in an intermediate line using the ink ejection ports at the downstream side of the head: deterioration of precision in feeding of the printing medium for fractional recording.

(D) Fractional recording in the last line using the ink ejection ports at the upstream side of the head: deterioration of precision in feeding of the printing medium for fractional recording.

(E) Fractional recording in the last line using the ink ejection ports at the downstream side of the head: increase of the rear end blank or deterioration of its dimensional precision which leads to deterioration of precision in feeding of the printing medium for fractional recording.

The above-described examples are those of simplest image formation, and in an apparatus which reads an object image and makes a copy, the above fractional recording may occur frequently.

An example thereof is an image repeat function in which, as shown in FIG. 22, a part of the object image is extracted and repeatedly printed. The image area of image repeat is generally designated by the operator, when an object image of a width Y and a length K is repeated in the feeding direction of arrow C of the printing medium P as shown in FIG. 23A, the length K is not always guaranteed to be an integer multiple of printing width X of the entire ink ejection ports width of the print head. When the length K is smaller than the printing width X of the entire ink ejection ports width of the print head, in the past, a process has been repeated in which after making fractional recording of one line using the ink ejection ports corresponding to the width K at the downstream side of the print head, the printing medium P is fed by a distance equal to the length K. Further, as shown in FIG. 23B, when the length K is greater than the printing width X, an integer multiple of the printing width x is subtracted from the length K, and the same fractional recording is made for the remainder print portion. Therefore, when forming such an image, fractional recording must be made many times during printing on a sheet of the printing medium P, and deterioration of feeding precision of the printing medium P during fractional recording has been a major problem.

SUMMARY OF THE INVENTION

A primary object of the present invention is to provide a printing method and apparatus which, when an image is divided into a plurality of lines and printed, the feeding amount of a printing medium in each line is made equal to each other to eliminate feeding error of the printing medium thereby obtaining a high-quality image.

In order to accomplish the above-mentioned object, there is provided a printing method using a print head including a plurality of printing elements, the print head being repeatedly scanned in a direction perpendicular to a feeding direction of a printing medium for printing an image line by line on the printing medium, wherein the image printed in a top line at a downstream side with respect to the feeding direction of the printing medium is formed into a printable image by a specific number of printing elements located at an upstream side with respect to the feeding direction of the printing medium among the plurality of printing elements.

Further, there is provided a printing apparatus using a print head including a plurality of printing elements for printing an image line by line on a printing medium by repeatedly scanning the print head in a direction perpendicular to a feeding direction of the printing medium the apparatus comprising:

setting means for setting the image printed in a top line at a downstream side with respect to the feeding direction of the printing medium is formed into a printable image by a specific number of printing elements located at an upstream side with respect to the feeding direction of the printing medium among the plurality of printing elements; and control means for printing the image set by the setting means in the top line of the printing medium.

In accordance with the present invention, an image to be printed in the top line at the downstream side with respect to the feeding direction of the printing medium is formed into a printable image by a specific number of printing elements in a print head, the specific number of printing elements being disposed at the upstream side with respect to the feeding direction of the printing medium and capable of making image formation without making fractional feeding which has heretofore been a cause of feeding error by adjusting the image formation area in the top line according to the relation between the image printed dividedly in a plurality of lines on the printing medium and the printable area on the printing medium.

Further, when the printing medium is fed intermittedly in an equal amount during operations after printing the image of the top line until the completion of printing the image of the last line at the upstream side with respect to the feeding direction of the printing medium, feeding error of the printing medium can be eliminated by equalizing the feeding amount of the printing medium.

Still further, when printing a plurality of images on the printing medium by shifting in the feeding direction, for each of the plurality of images, the image portion of the top line side with respect to the feeding direction is formed into a printable image by the specific number of printing elements to equalize the feeding amount of the printing medium for printing the plurality of images thereby eliminating feeding error of the printing medium.

Yet further, by feeding the printing medium in the equalized amount every time a feeding roller makes one turn, a high-quality image can be printed without depending on the machining precision of components of the feeding means.

Yet further, it is possible to maintain an image blank generated at the front or rear end of the printing medium of different sizes. By making the feeding amount of the printing medium always in line with the circumferential length of the feeding roller, feeding error due to eccentricity of the feeding roller and the like during feeding of the printing medium can be completely eliminated to provide a high-quality image. Deviation of feeding amount due to eccentricity of the feeding roller and the like in the printing medium feeding system is offset, thereby enabling printing of a high-quality image by an intensive structure without using a specially complicated mechanism.

DETAILED DESCRIPTION OF THE PREFERRED EMBODIMENT

First Embodiment

FIGS. 1 to 5 are illustrations for explaining the first embodiment of the present invention. The present embodiment is an application as an ink-jet printing apparatus.

Figure 1:
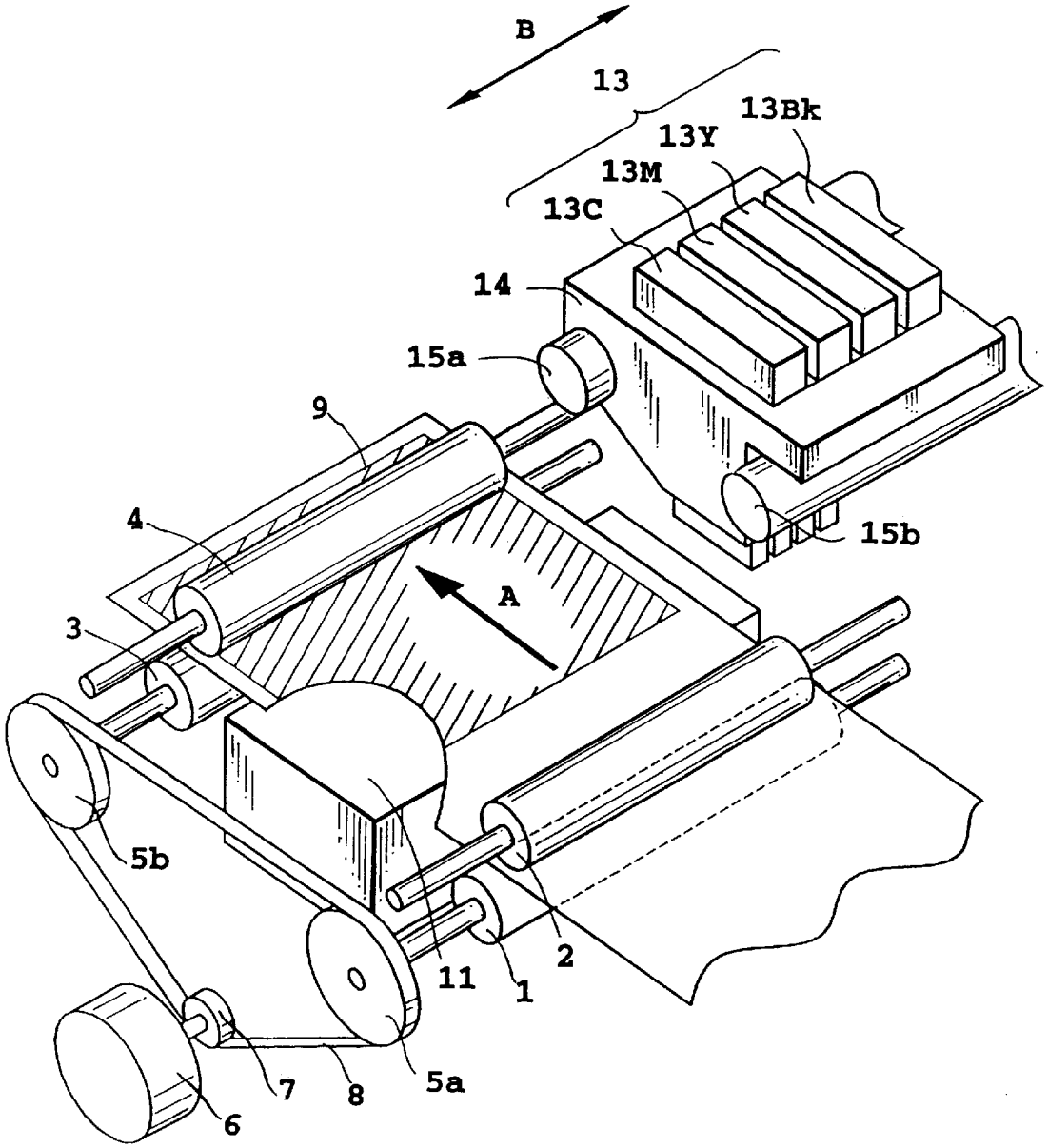
FIG. 1 is a schematic perspective view of a first embodiment of an image formation unit in the printing apparatus in accordance with the present invention.
Figure 2:
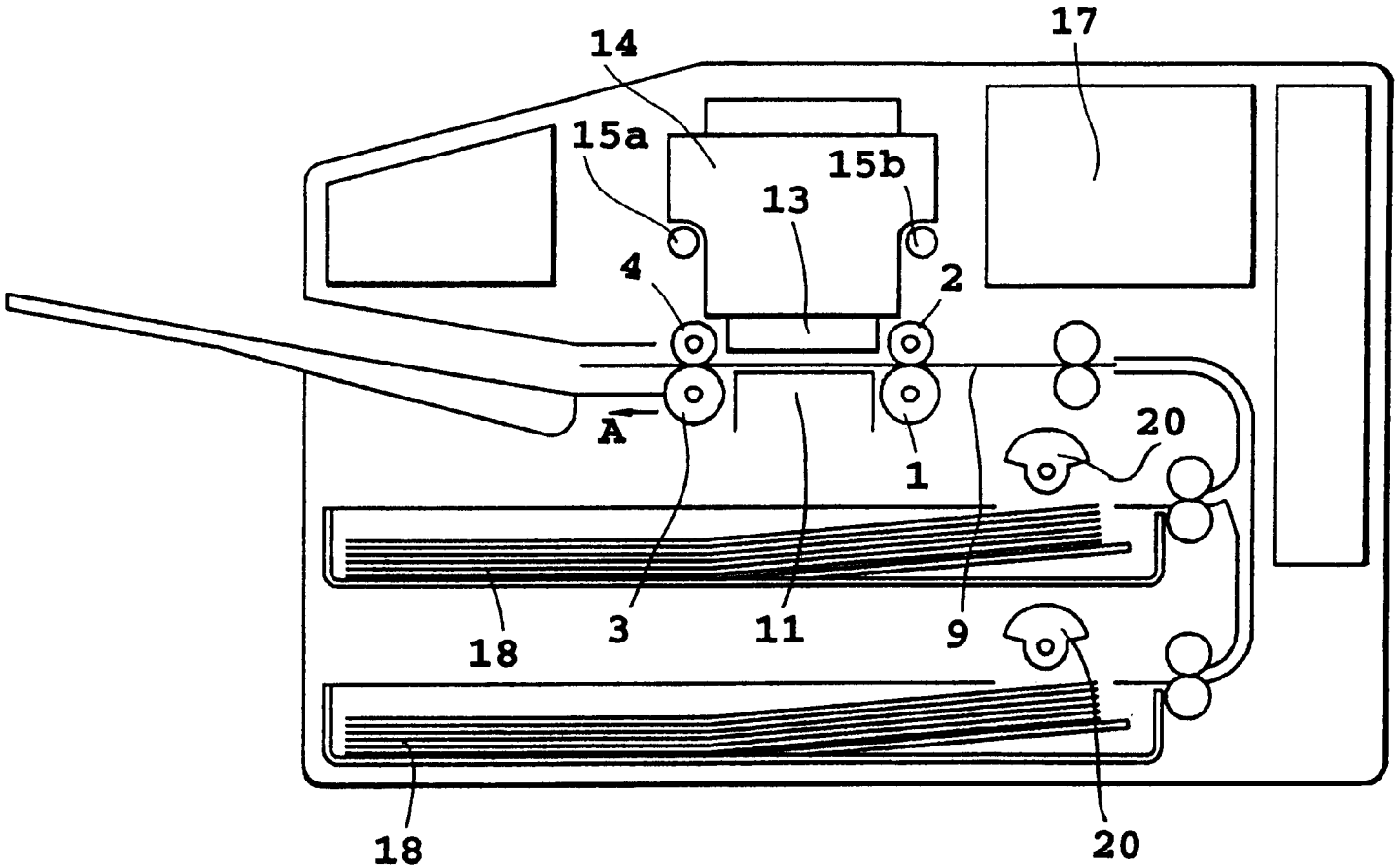
FIG. 2 is a schematic side view of the first embodiment showing the main unit of the printing apparatus in accordance with the present invention.

FIG. 1 is a schematic perspective view showing the printing operation unit in the ink-jet printing apparatus of the present embodiment, and FIG. 2 is a cross sectional view of the main portion of the same apparatus.

In FIG. 1, the numeral 1 indicates a feeding roller disposed at the upstream of the printing operation unit, 2 is a driven roller urged in the opposite direction of the roller 1. In this apparatus, a printing width of one line by the entire ink ejection ports of the print head is set to 32.512 mm, and a diameter D1 of the feeding roller 1 is 10.349 mm so that the circumferential length of the feeding roller 1 is equal to the printing width.

Similarly, a discharge roller 3, and a driven roller 4 urged in the opposite direction of the roller 3 are disposed at the downstream of the image formation unit. A diameter D2 of the discharge roller 3 is set 2% greater than the diameter D1 of the feeding roller 1 (D2=D1×1.02). Further, the ratio of the urging pressure of the upstream side driven roller 2 and the urging pressure of the downstream side driven roller 4 is set to about 4:1. As a result, the discharge roller 3 feeds a printing medium 9 while slipping to the extent of the greater diameter than the feeding roller 1, thereby preventing the printing medium 9 from rising or slackening in the printing operation unit. Further, when the printing medium 9 is pinched respectively between the roller 1 and the roller 2, and the roller 3 and the roller 4, the feeding amount of the printing medium 9 depends only on the feeding roller 1.

Pulleys 5*a* and 5*b* are pressed in at respective one ends of each shaft of the feeding roller 1 and discharge roller 3, and the pulley 5*a* and 5*b* are driven by a pulse motor 6 through a motor pulley 7 and a transmission belt 8 such as a toothed belt. An endless body such as a chain can be used in place of the transmission belt 8. The ratio of circumferential lengths of the pulleys 5*a*, 5*b* to circumferential length of the motor pulley 7 is set to an integer ratio of 6:1, and machining precision of the motor pulley 7 does not affect the feeding precision during normal feeding, that is, as far as the feeding roller 1 makes integer number of rotations. It should be noted that the term "ratio" means a ratio with respect to the number of teeth when a toothed belt is used as the transmission belt.

The pulse motor 6 used in the present embodiment is an inexpensive one as a drive source of this type, a two-phase hybrid type with a basic step angle of 1.8 degrees which is driven by 1–2 phase excitation, and the feeding amount of the printing medium 9 per drive pulse is about 13 $\mu$m.

The numeral 11 is a platen for supporting the printing medium 9 in the image formation it, and 13 is an ink-jet type print head. In the present embodiment, the print head 13 is provided with print heads 13C, 13M, 13Y, and 13Bk juxtaposed in the scanning direction for discharging four color inks of cyan, magenta, yellow, and black to make full-color image formation. The individual print heads 13C, 13M, 13Y, and 13Bk have 512 ink ejection ports arranged in a line in a 400 DPI pitch along the feeding direction of the printing medium 9, and inks of the individual colors are ejected from the ink ejection ports. The individual ink ejection ports form printing elements for ejecting the inks.

The print head 13 is mounted on a carriage 14 which is movable in a direction of arrow B along guide rails 15*a* and 15*b*, and makes printing of 32.512 mm wide of one line on the printing medium 9 every time when it is scanned with the carriage 14 in the direction of arrow B. Every time the one line printing is completed, the printing medium 9 is fed in a direction of arrow A by a distance equal to the one line printing width, and the operation is repeated to form an image line by line on the printing medium 9. Driving of the carriage 14 is made through a pulse motor (not shown) and a drive belt (not shown). FIG. 2 is a schematic side view of the main portion of this apparatus. 17 is a CPU (central processing unit) for controlling the pulse motor and so forth.

Figure 3:
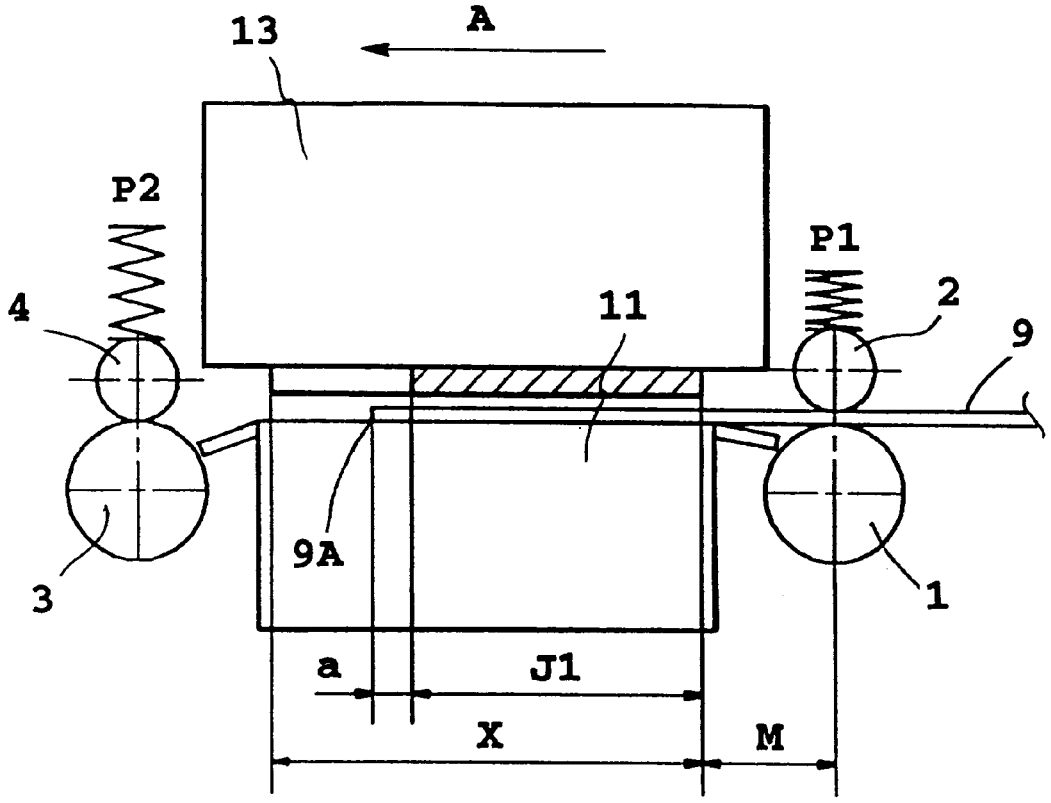
FIG. 3 is a schematic side view for explaining the dimensional relations of the image formation unit shown in FIG. 1.
Figure 4:
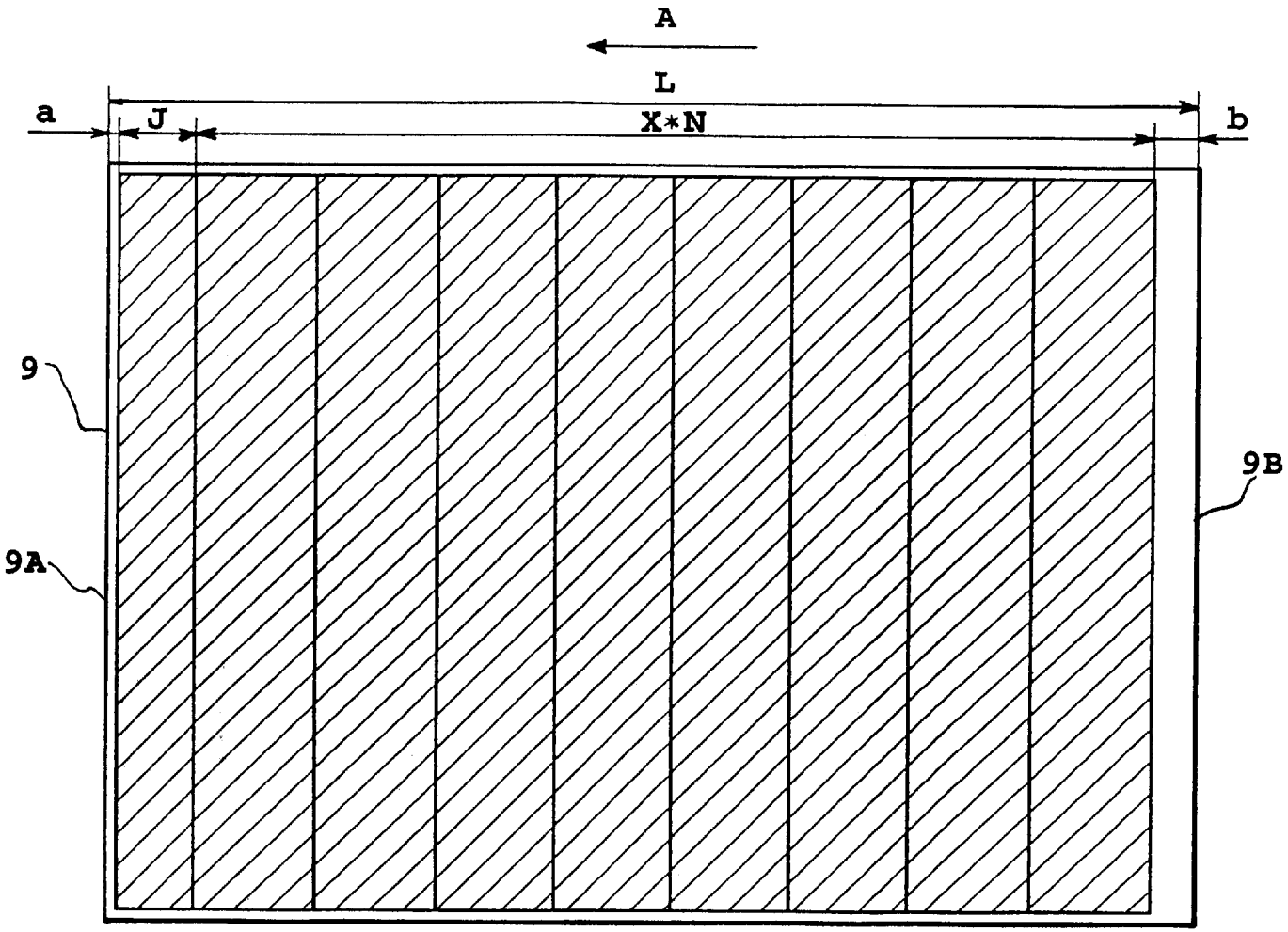
FIG. 4 is a schematic plan view of the first embodiment showing the image formed on the printing medium by the printing apparatus in accordance with the present invention.

FIG. 3 shows dimensional relations of the image formation unit of this apparatus In FIG. 3, 9A is the leading edge at the downstream side with respect to the feeding direction of the printing medium 9. In FIG. 4, 9B is the rear end at the upstream side with respect to the feeding direction of the printing medium 9.

Specific values in the present embodiment are as follows:

Maximum printing width X of one line by all ink ejection ports=32.512 mm; blank width a of the leading edge 9A side=3 mm; blank width b of the rear end 9B side=12 mm; ink ejection ports interval c=0.0635 mm; distance m from feeding roller center to recording area upstream end=10 mm.

Specific values set in the present embodiment are shown in [].

In the present apparatus, the following control is made before printing in order to maintain blanks a and b as constant values even when printing is made using printing media 9 of different sizes.

The size of the printing medium 9 is previously detected by a detection device (not shown) in a cassette 18 shown in FIG. 2 or by an operator's input. As a detection method of the size of the prints medium 9, a method can be used in which according to selection data of the cassette 18 as supply means of the printing medium 9 or to content of an operator's instruction, size data which is previously related to the selection data or the content is read and recognized. Further, as another detection method, a method can be used in which the size of the printing medium 9 other than standard sizes is detected according to the passing time and passing speed of the printing medium 9 at a specified position in the transportation path of the printing medium 9. A case for making printing on the printing medium 9 of A4R (A4 size which is fed a longitudinal direction thereof) size will now be described. FIG. 4 shows the printing medium 9 after printing.

Since the total length L of the printing medium 9=297 mm, $$\text{actually printed area:}L-a-b[=282\text{ mm}] \quad (1)$$

number of times N of printing by the maximum printing width X is, $$N=\mathrm{INT}((L-a-b)/X)[=8\text{ times}] \quad (2)$$

calculation width J1 of fractional recording is, $$J1=(L-a-b)-(N\times X)[=21.904\text{ mm}] \quad (3)$$

wherein INT means an integer.

Further, printing of a narrower printing width than usual is referred to as "fractional recording", calculation width of the fractional recording is referred to as "calculative fractional recording width J1", and actual width of the fractional recording is referred to as "actual fractional recording width J".

After the above calculation, in FIG. 2, the printing medium 9 is fed from the cassette 18 by a paper feed device 20, when the leading edge 9A of the printing medium 9 reaches a pinch section between the feeding roller 1 and the driven roller 2, the feeding roller 1 is rotated to feed the printing medium 9 by a predetermined distance (M+J1+a) [=34.904 mm], and the printing medium 9 is stopped in the state of FIG. 3. Printing of the first line is performed from this state, however, in the present embodiment, fractional recording is performed using ink ejection ports corresponding to the width J1 at the upstream side with respect to the feeding direction of the printing medium 9.

Since the ink ejection ports of the print head 13 have intervals e, when making fractional recording of calculative fractional recording width J1, the actual fractional recording width J is an integer multiple of the ink ejection ports interval e. Therefore, the actual fractional recording width J closest to the calculative fractional recording width J1 is determined by $$J=\{\mathrm{INT}\ (J1/e+0.5)\}\times e\ [=21.908\text{ mm}] \quad (4)$$

(the process of adding 0.5 and omitting fractions is rounding).

A difference between the calculative fractional recording width J1 and the actual fractional recording width J is ±e/2 at a maxim, that is, about 30 $\mu$m. However, this error only increases or decreases the blank width a of the leading edge, and does not affect the generation of connection stripes during feeding of the printing medium 9.

After completion of the fractional recording of the first line, that is, after the completion of fractional recording of the top line at the downstream side with respect to the feeding direction of the printing medium 9, the recording material 9 is fed by the printing width X by the feeding roller 1. In the present apparatus, feeding of the printing width X is performed by one turn of the feeding roller 1, and almost no feeding error occurs due to eccentricity of the roller 1, pulley 5*a*, and motor pulley 7.

Figure 5:
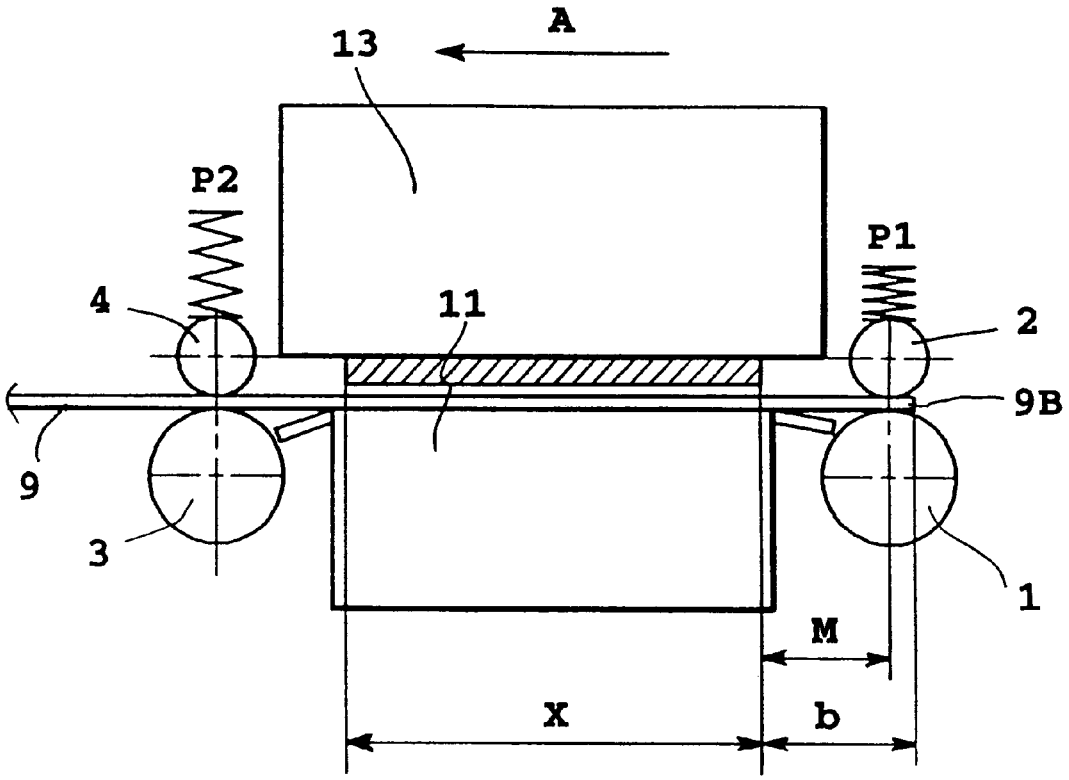
FIG. 5 is a schematic side view showing a condition of making printing of the last line by the image formation unit shown in FIG. 1.

After the second line and beyond, printing of the normal printing width which is maximum printing width X and feeding of the printing medium 9 by the printing width X are repeated. Therefore, the stop position of the printing medium 9 during printing of the last line at the upstream side with respect to the feeding direction of the printing medium 9 is the position as shown in FIG. 5, and blank width of the rear end 9B is b. The state shown in the figure is the printing condition of the last line, and thereafter, since the printing medium 9 is only discharged, feeding precision is not required.

As described above, since, in the present embodiment, the fractional recording is performed by the ink ejection ports at the upstream side with respect to the feeding direction of the printing medium 9, after the fractional recording of the top line to the completion of the last line printing, the feeding amount of the printing medium 9 is equal to the circumferential length of the feeding roller 1, and deterioration of image quality does not occur due to eccentricity of the feeding roller 1, eccentricity of the pulley 5*a*, or eccentricity of the motor pulley 7 over the entire image.

Second Embodiment

A second embodiment according to the present invention for achieving a similar object will be described below.

The present embodiment is an application example as a copier provided with a reading unit on an ink-jet printing apparatus for enabling copying of the object image on a printing medium.

Figure 6:
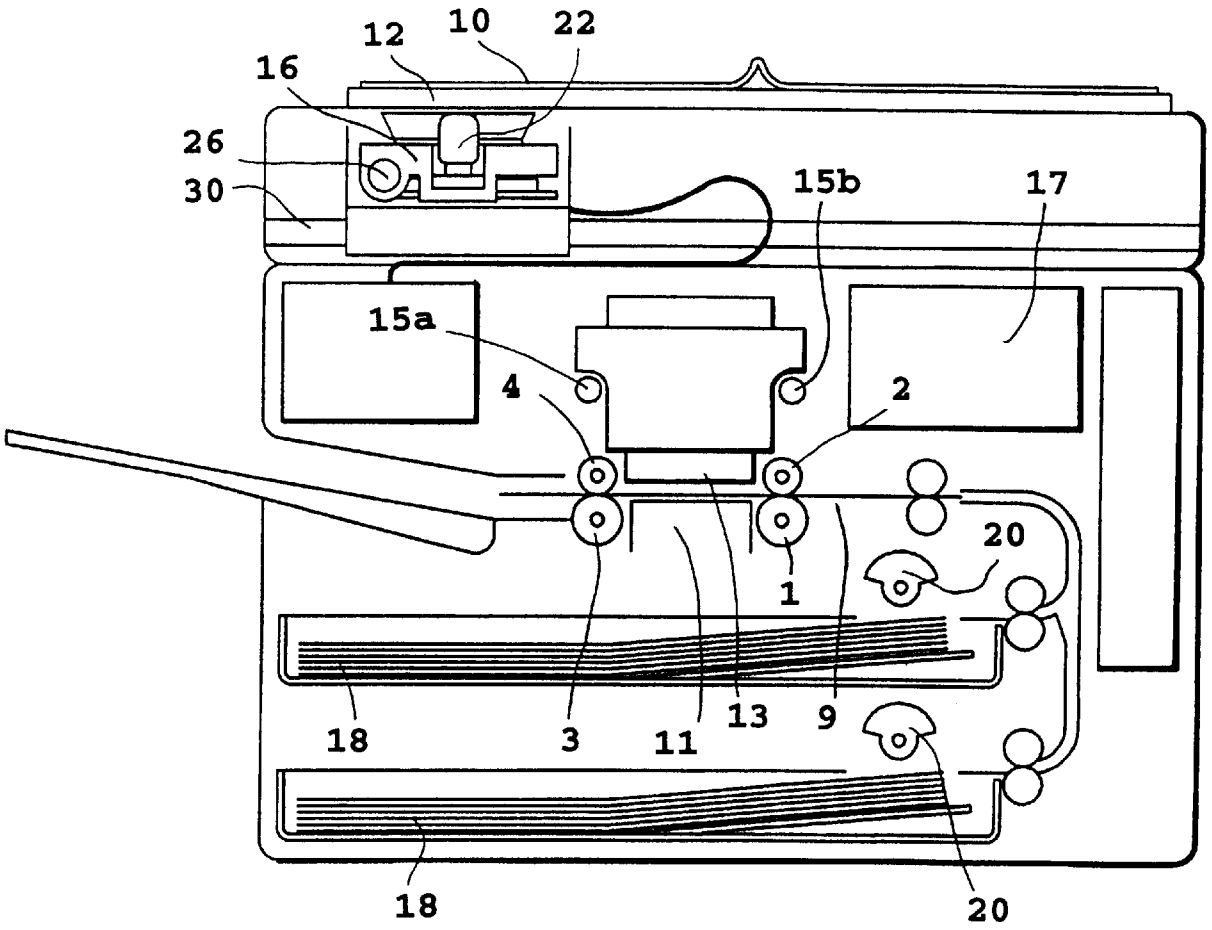
FIG. 6 is a schematic side view of a second embodiment showing a main portion of the printing apparatus in accordance with the present invention.
Figure 7:
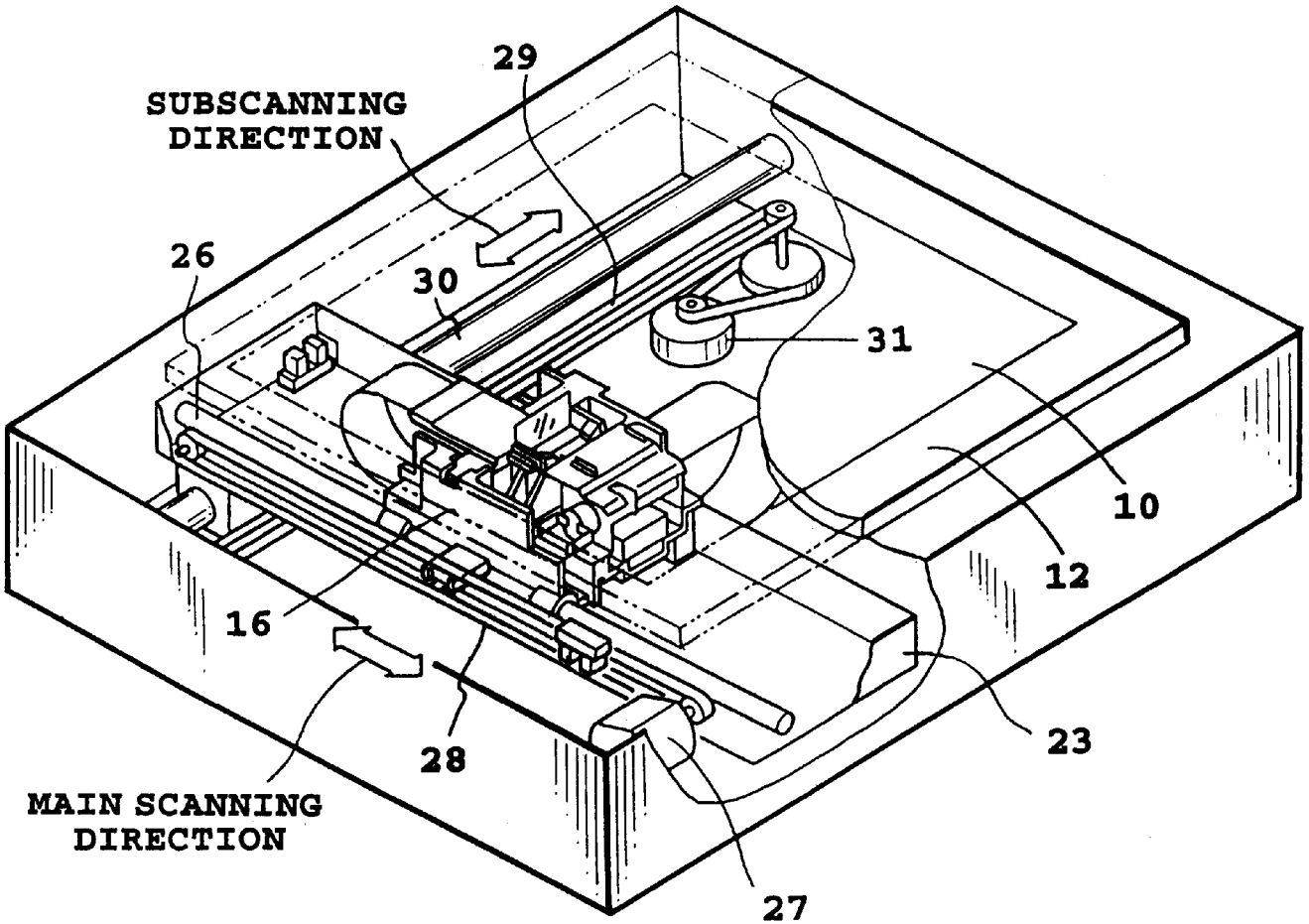
FIG. 7 is a schematic perspective view showing a reading unit show in FIG. 6.
Figure 8:
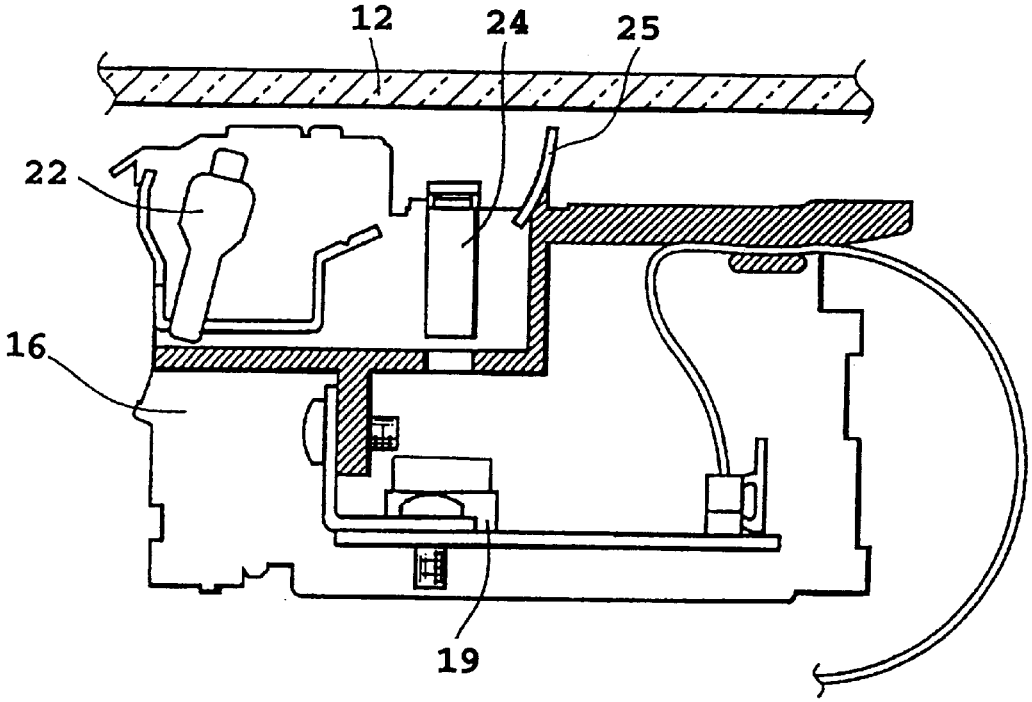
FIG. 8 is a schematic sectional view showing a main portion of a reading carriage shown in FIG. 7.

FIG. 6 is a schematic side view showing part of the copier of the present embodiment, FIG. 7 is a schematic perspective view showing the reading unit, and FIG. 8 is a schematic cross sectional view showing a main portion of a reading carriage for reading the image. Since the construction of the image formation unit is similar to that of the above first embodiment it is described using similar reference symbols.

The reading unit used in the present apparatus is a so-called serial scan type reading device which reads an image line by line according to the operation of an image formation unit.

In FIG. 7, the numeral 10 indicates an original which is placed on an original glass 12. The numeral 16 is a reading carriage, which, as shown in FIG. 8, is equipped with a CCD sensor 19 and a light source 22. The reading carriage 16 is guided by a main scanning rail 26 and driven by a drive motor 27 through a drive belt 28 to be moved in a main scanning direction (a direction perpendicular to the arrangement direction of sensor elements of the CCD sensor 19) on a main scanning table 23. On the other hand, the main scanning table 23 is guided by a sub scanning rail 30 and driven by a drive motor 31 through a drive belt 29 to be moved in a sub scanning direction (a direction parallel to the arrangement direction of the sensor elements of the CCD sensor 19) perpendicular to the main scanning direction. In FIG. 8, 22 is a light source for lighting the surface of the original 10, 25 is a reflector plate for converging light from the light source 22 onto a predetermined position at the surface of the original 10, 19 is the CCD sensor for generating an electrical signal according to the reflected light from the surface of the original 10, and 24 is a lens array for focusing the reflected light from the surface of the original 10 to the CCD sensor 19.

Next, operation when reading the object image of the original 10 in the present apparatus will be described.

The reading carriage 16 in the present apparatus is movable to desired X, Y coordinates in the main and sub scanning directions, and is provided with the CCD sensor 19 capable of reading the part of the object image by a width equal to the printing width of the print head 13. Specifically, the number of picture elements which can be read in the sub scanning direction of the CCD sensor 19 per one scanning in the main scanning direction, that is, corresponding to the number of ink ejection ports of the print head 13, so that while the CCD sensor 19 is scanning in the main scanning direction, the object image is read to the reading width corresponding to the 1 print line. On the other hand, in the image formation unit, while the print head 13 is being scanned in the main scanning direction, the object image read by the CCD sensor 19 is printed in a line on the printing medium 9. After the one line printing is completed, the reading carriage 16 is returned to the starting position of reading, and the main scanning table 23 carrying the carriage 16 is moved by the reading width in the sub scanning direction. In the image formation unit, according to such operation, the print head 13 is returned to the recording start position, and the printing medium 9 is fed in an amount equal to the printing width. Thereafter, similar procedures are repeated to make image formation of 1 page.

As to the sensor elements of the CCD sensor 19, in the arrangement direction (sub scanning direction), the side of intermittently moving in the sub scanning direction is referred to as a stream side, which is related to the ink ejection ports at the upstream side of the print head 13.

Figure 9:
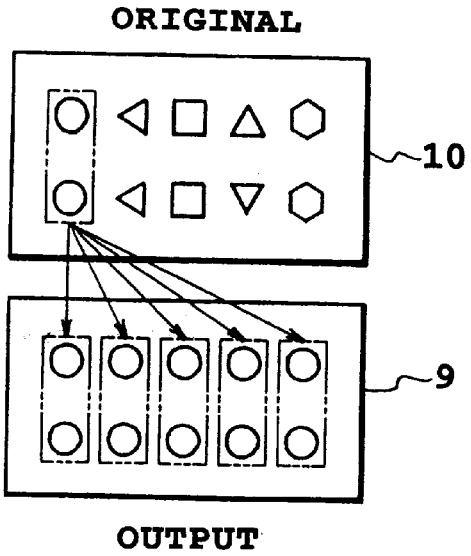
FIG. 9 is a schematic view for explaining an image repeat function of the printing apparatus shown in FIG. 6.
Figure 10:
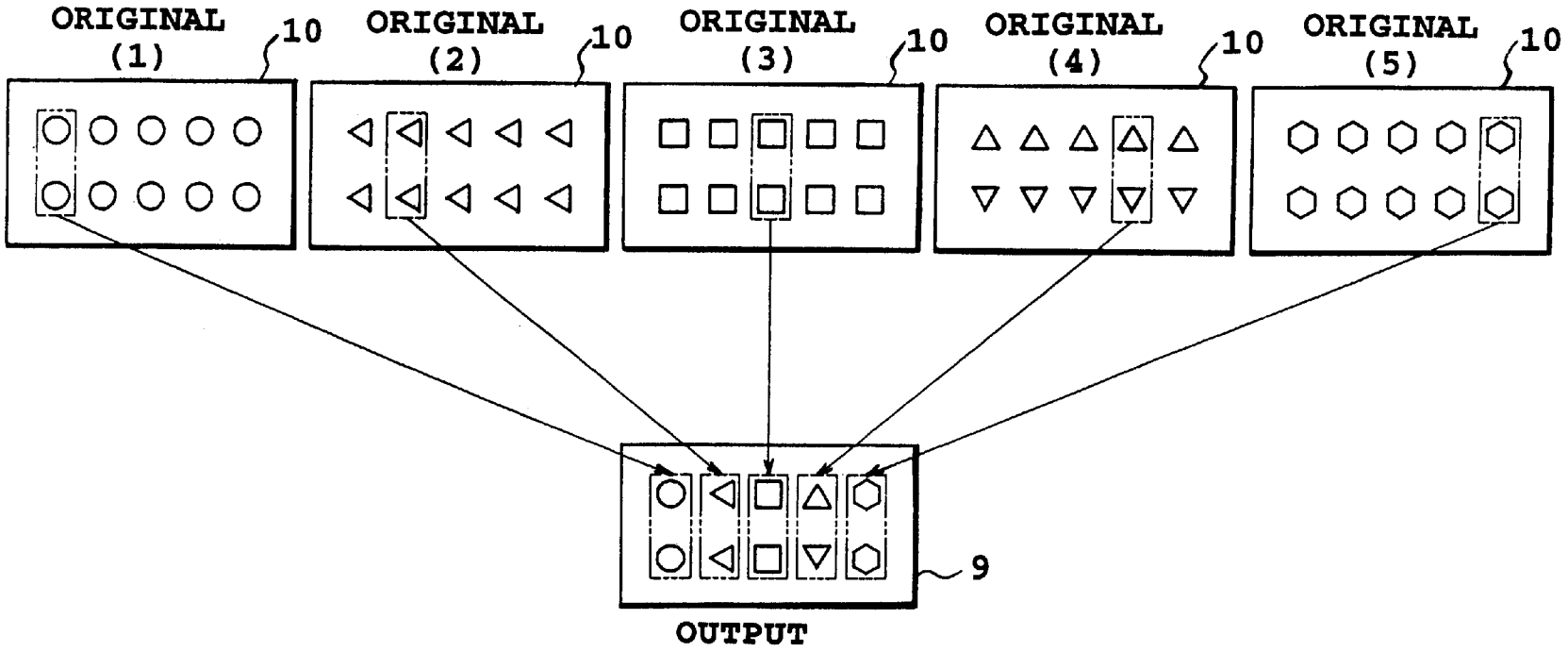
FIG. 10 is a schematic view for explaining an image synthesis function of the printing apparatus shown in FIG. 9.

Whereas the above-described first embodiment is a case where the simplest image formation is performed only by the image formation unit, the present apparatus of the second embodiment can be combined with a reading unit to be used as a copier. Recently, copiers have become multifunctional and some have edit functions for complex image. For example, as shown in FIG. 9, an image repeat mode in which a desired part on the same original 10 is repeatedly printed on the printing medium 9, or as shown in FIG. 10, an image synthesis mode in which images of different originals 10 are synthesized on one sheet of the printing medium 9, and the like, may be accomplished.

In the present embodiment, also when making image formation as above, the construction is designed so that the feeding amount of the printing is medium 9 can be maintained at a constant value after printing the top line to the completion of printing the last line.

Specific values are shown in [] and described below.

Figure 11:
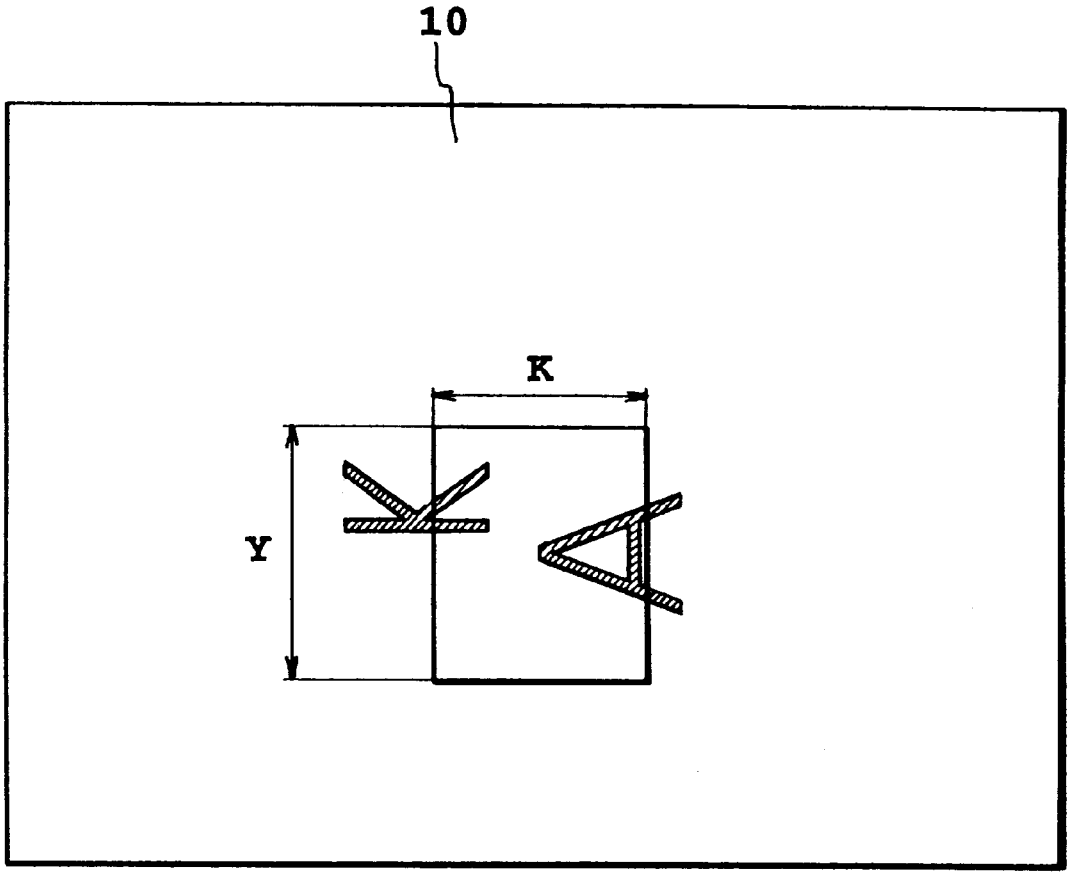
FIG. 11 is a schematic view for explaining operation of the reading unit when the printing apparatus shown in FIG. 6 makes an image repeat operation.
Figure 12:
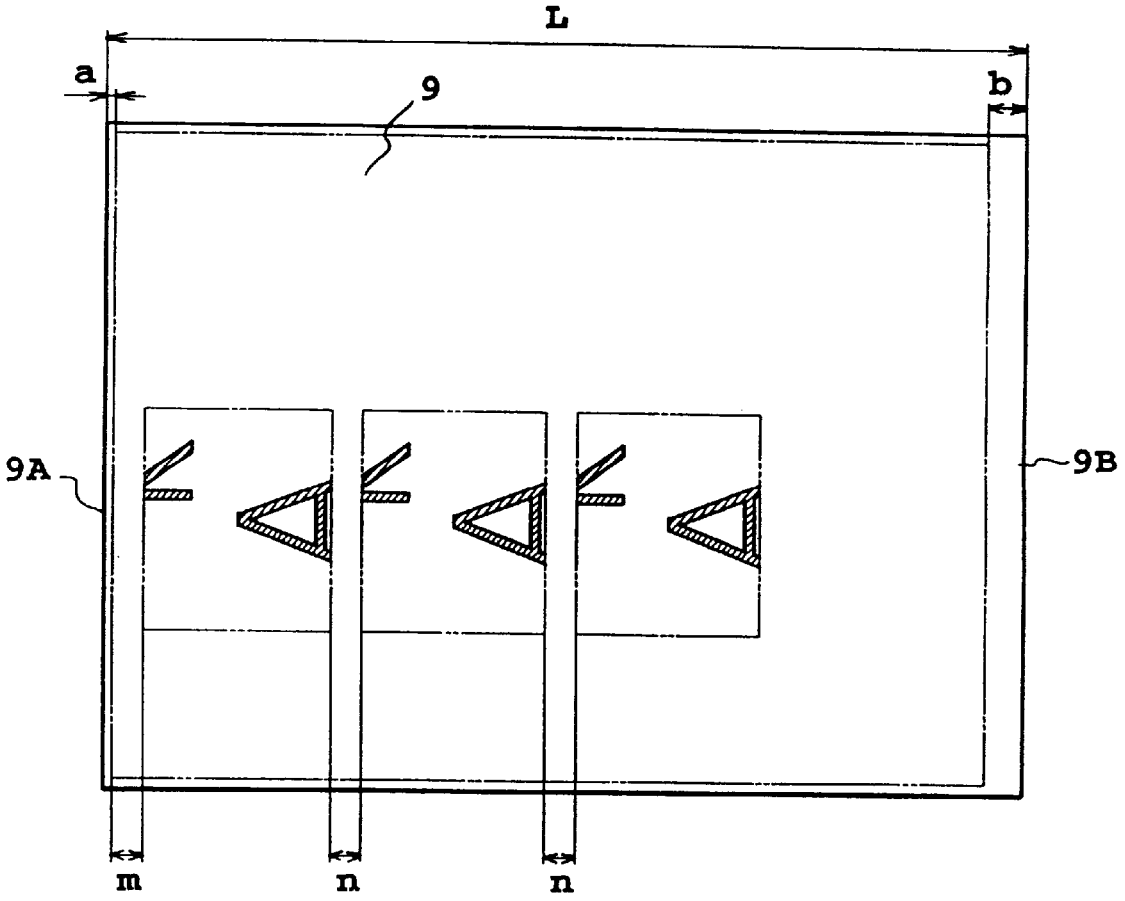
FIG. 12 is a schematic view for explaining operation of the image formation unit when the printing apparatus shown in FIG. 6 makes the image repeat operation.

Here, a case is assumed that an object image of width K [=60 mm], and length Y [=70 mm] as shown in FIG. 11 is repeatedly printed f [=3] times spaced by an interval n [=10 mm] from a position spaced apart by a distance m [=10 mm] from the end of the printable area so as to make the image shown in FIG. 12. Now, only the sub scanning direction is considered.

Figure 13:
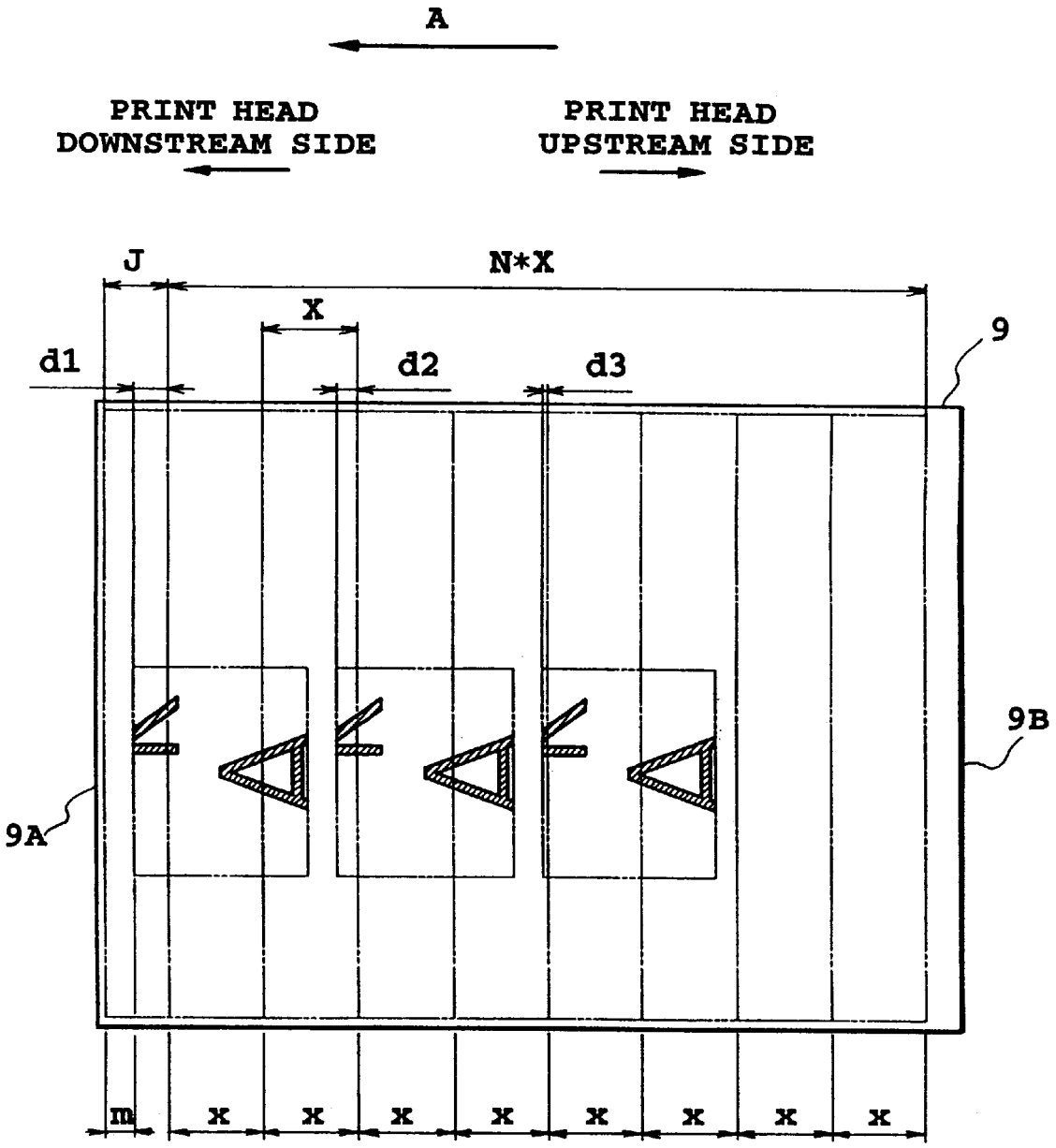
FIG. 13 is a schematic view for explaining operation of the image formation unit when the printing apparatus shown in FIG. 6 makes an image repeat operation.

If the total length L [=297 mm] of the printing medium 9, the blank width a [=3 mm] of the leading edge 9A, the blank width b [=12 mm] of the rear end 9B are the same as in the previous embodiment, the number of times N [=8 times] when printing is made with the actual fractional recording width J [=21.9 mm], and the maxi printing width X [=32.512 mm] can be calculated. The relation between the printed line and the printing image is as shown in FIG. 13.

Next, line P of starting actual printing can be calculated as P [=1] to satisfy $m<(J+X\times(P-1))$. In the present embodiment, since printing is performed from the first line, the process for introducing the printing medium 9 into the image formation limit is the same as in the previous On the other hand, the reading it successively reads the specified area of the object image. The number of picture elements which can be read in the sub scanning direction of the CCD sensor 19 is optional, but the processing is simple when it is related to the used ink ejection ports of the print head 13. Therefore, a distance d1 is previously calculated by the following equation.

$$d1=J+X\times(P-1)-m[=11.9\ m] \quad (5).$$

Further, the number of picture elements (corresponding to the number of the ink ejection ports) S required for printing the width of the distance d1 is calculated by the following equation.

$$S=INT\ (d1/e+0.5)[=188] \quad (6)$$

wherein e is an ink ejection ports pitch of 63.5 $\mu$m.

Figure 14:
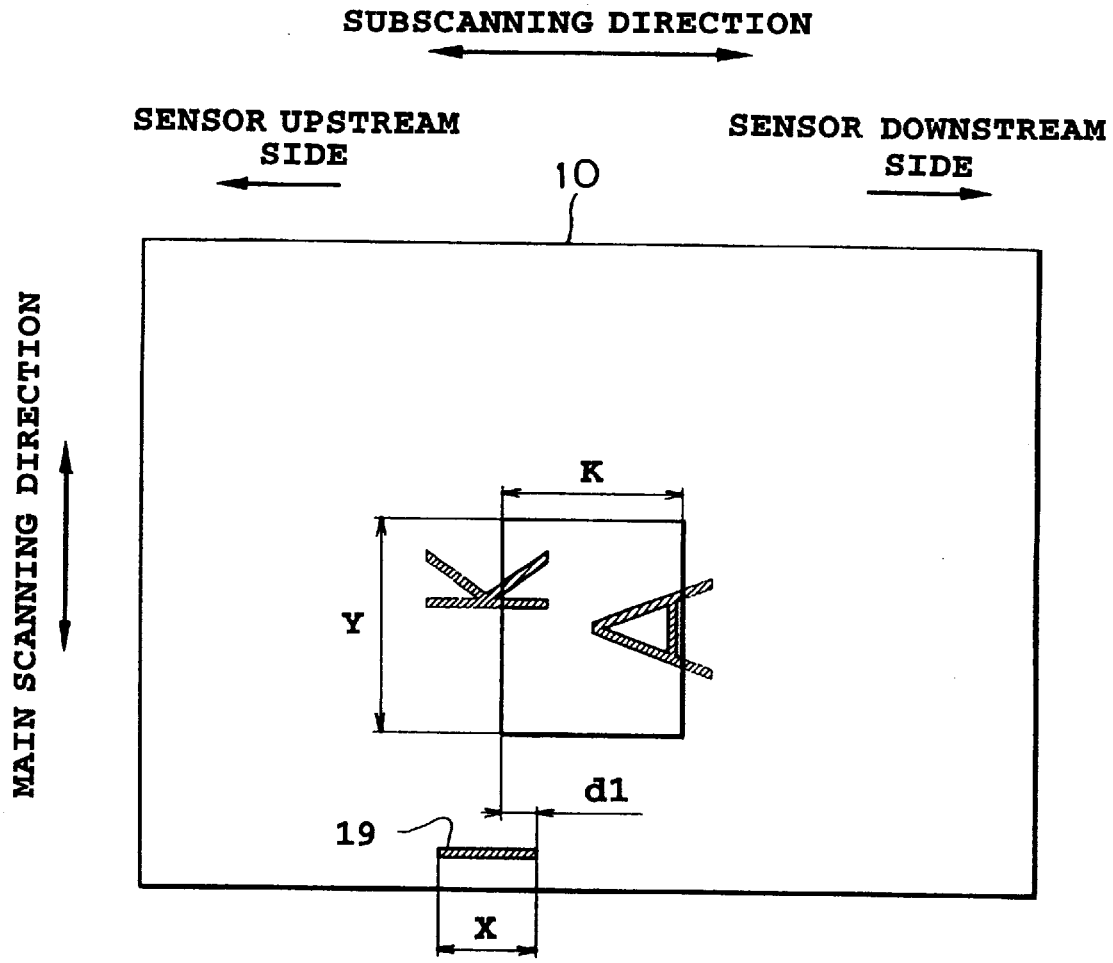
FIG. 14 is a schematic view for explaining operation of the image formation unit when the printing apparatus shown in FIG. 6 makes an image repeat operation.

In the reading unit, as shown in FIG. 14, after the end of the downstream side of the CCD sensor 19 is aligned to a position shifted by d1 from the leading edge of the first specified image area, scanning is started. On the other hand, in the image formation unit, the print head 13 perform printing according to the read picture elements. In this case, an image signal is transmitted only to the upstream side of the ink ejection ports corresponding to the number of picture elements S, and printing by the other ink ejection ports is not performed so that an image other than the specified image is not printed by the print head 13.

Since the next line is printed using all the ink ejection ports of the print head 13, both the CCD sensor 19 and the printing medium 9 are moved in the individual sub scanning direction by the maximum printing width X to perform printing. Whether or not to make this operation can be determined from the fact that the value of INT ((K−d1)/X) is an integer value of 1 or more.

Further, in the next line, since the above integer value is "0", it is known that printing of the initially specified image area is complete in this printing line. While it is the same as the previous line that both the CCD sensor 19 and the printing medium 9 are moved by the printing width X, in this line, the image signal is transmitted only to 246 ink ejection ports of the downstream side which can be calculated by INT ((K−d1−INT((K−d1)/X)×X)/e+0.5) [=246] to perform printing. Using the above procedure, printing of the first specified image area is completed.

Figure 15:
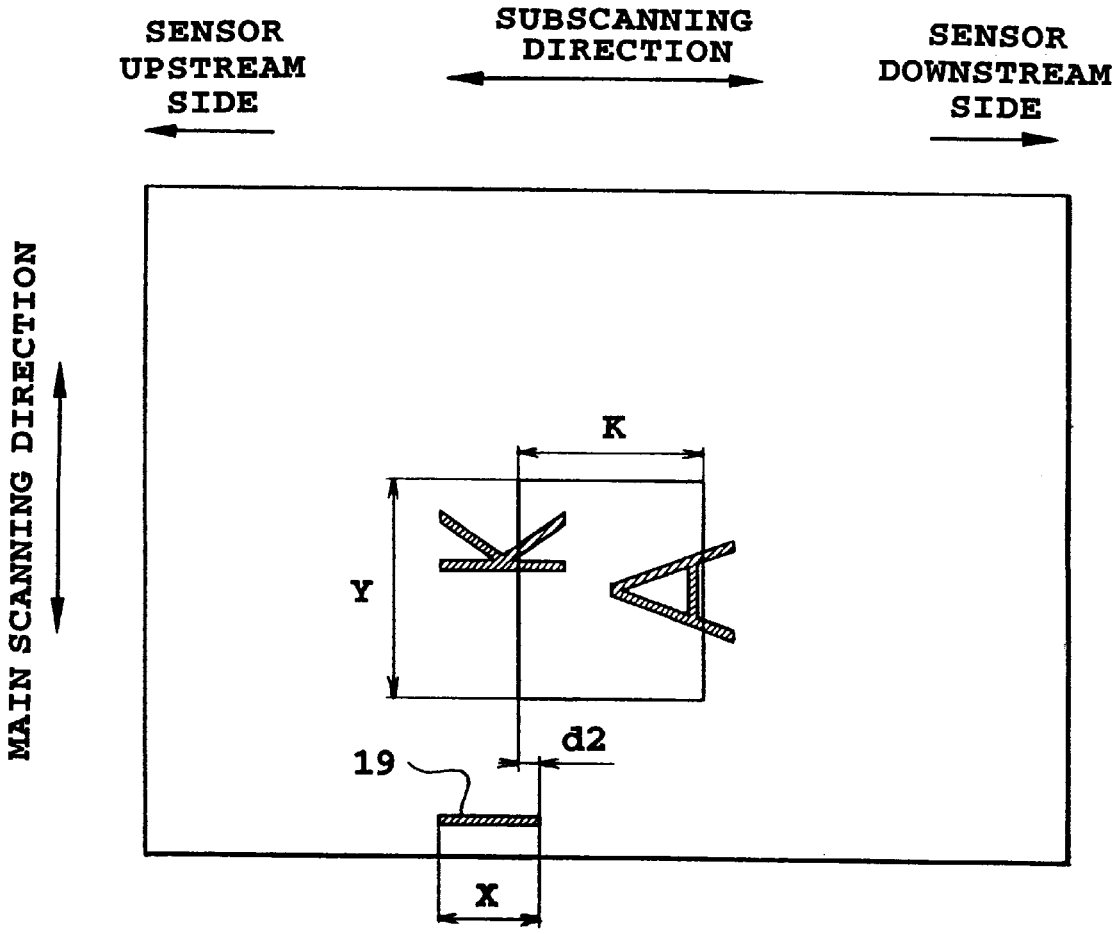
FIG. 15 is a schematic view for explaining operation of the image formation unit when the printing apparatus shown in FIG. 6 makes an image repeat operation.
Figure 16A:
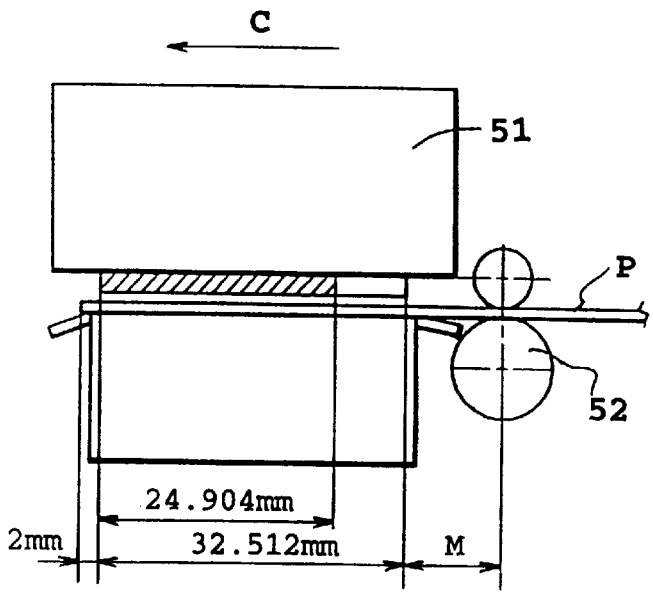
FIG.16A (PRIOR ART)
FIGS. 16A and 16B are schematic views for explaining operation when a prior art printing apparatus makes fractional recording in the top line.
Figure 16B:
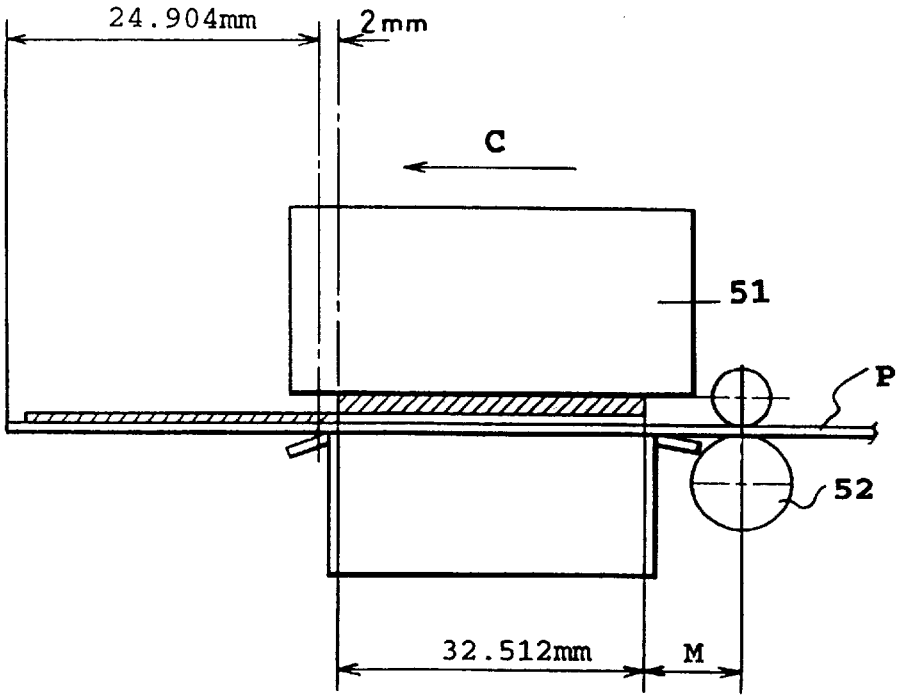
FIG.16B (PRIOR ART)
Figure 17A:
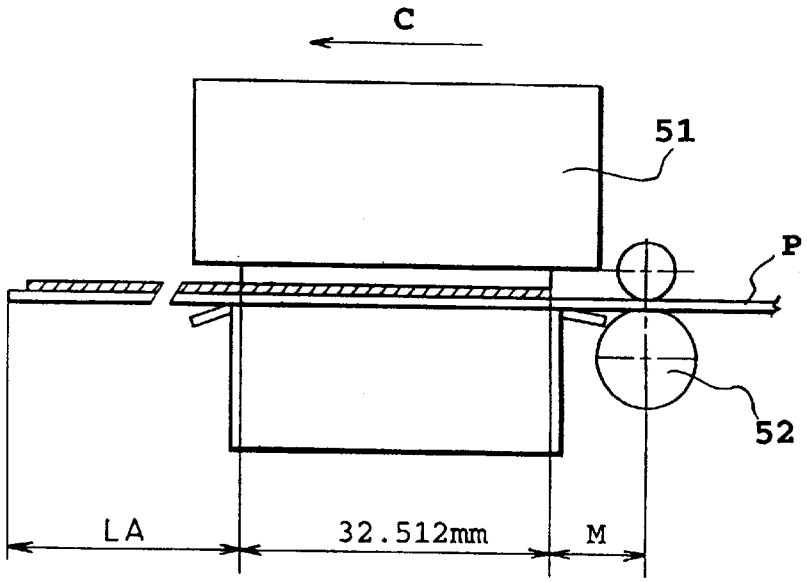
FIG.17A (PRIOR ART)
FIGS. 17A and 17B are schematic views for explaining operation when a prior art printing apparatus makes fractional recording in an intermediate line.
Figure 17B:
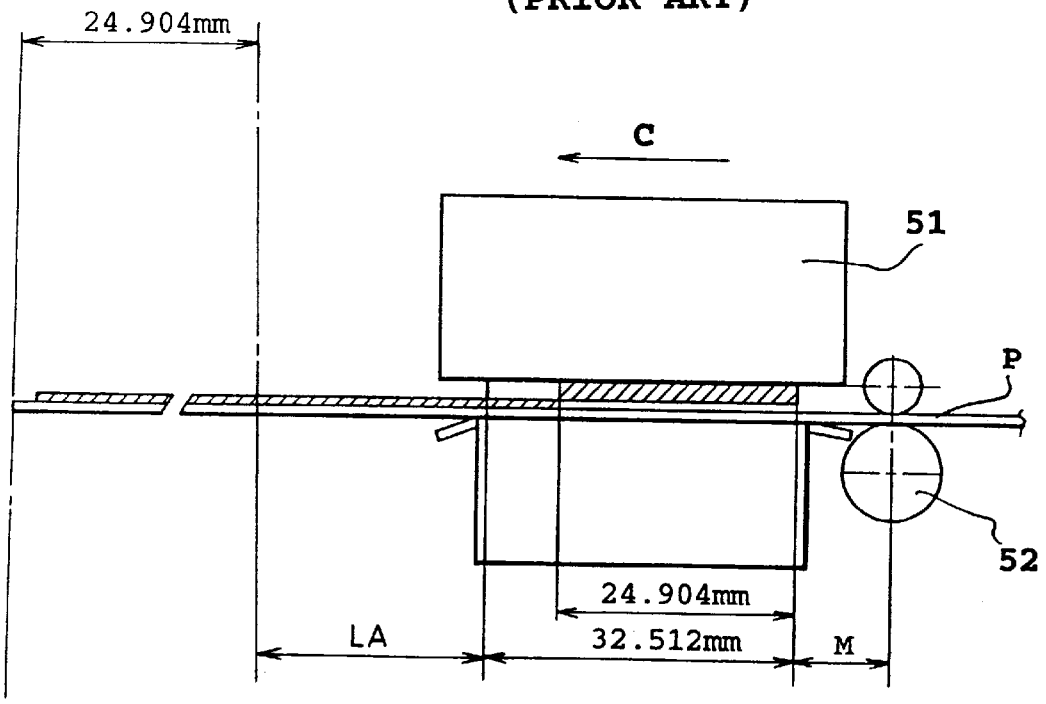
FIG.17B (PRIOR ART)
Figure 18:
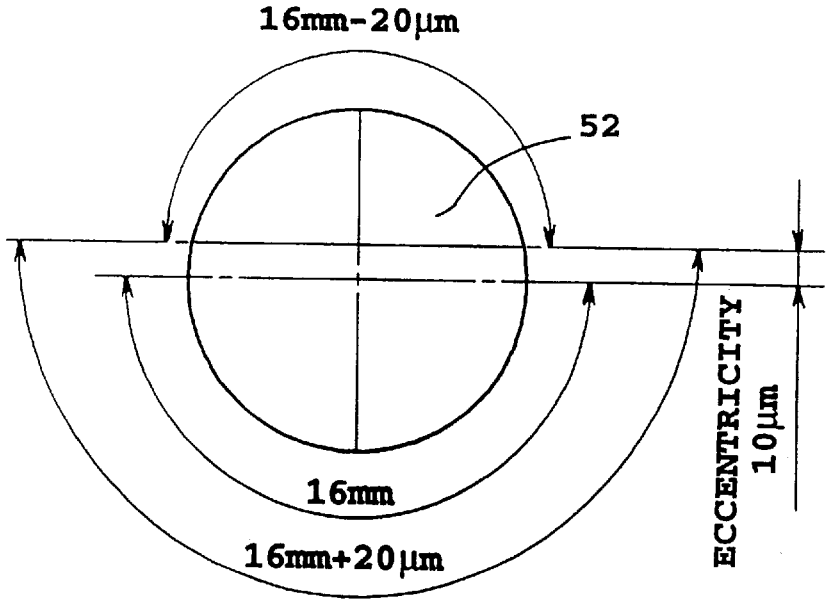
FIG. 18 (PRIOR ART)
FIG. 18 is a schematic view for explaining the relationship between machining precision of a feeding roller and feeding precision in a prior art example.
Figure 19:
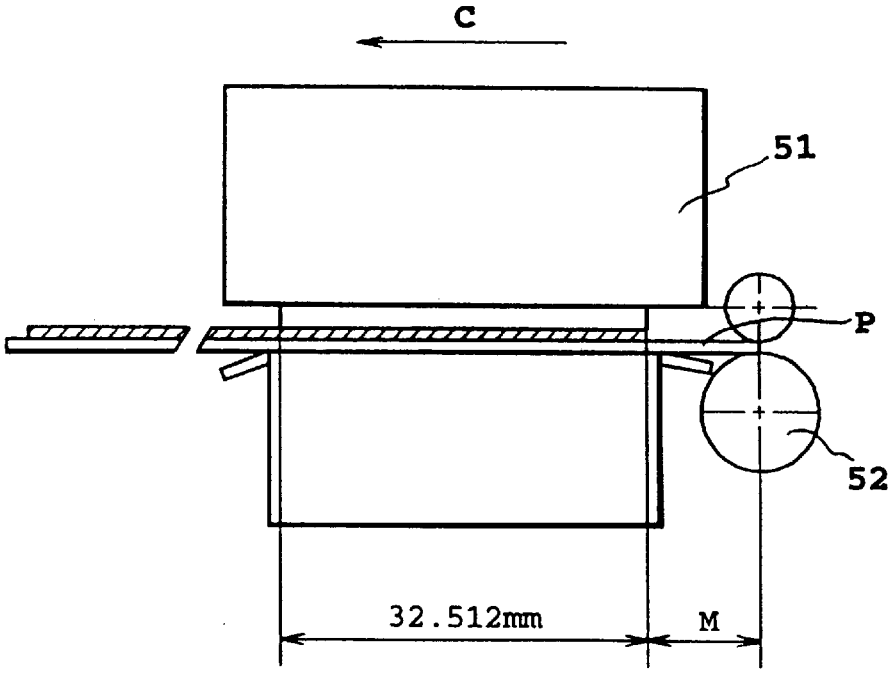
FIG. 19 (PRIOR ART)
FIG. 19 is a schematic view for explaining operation when fractional recording is made by a prior art printing apparatus.
Figure 20:
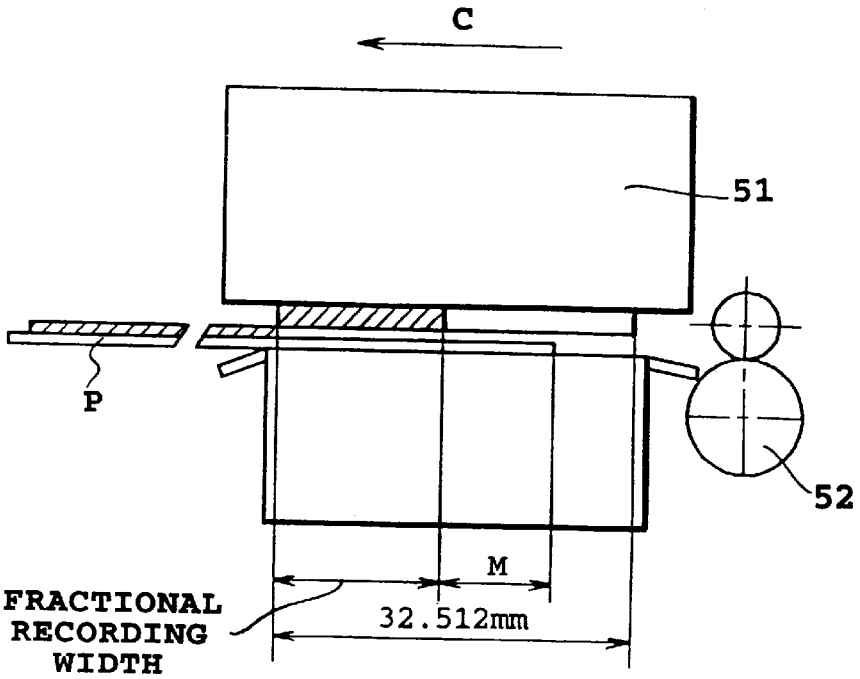
FIG.20 (PRIOR ART)
FIG. 20 is a schematic view for explaining operation when fractional recording is made by a prior art printing apparatus.
Figure 21:
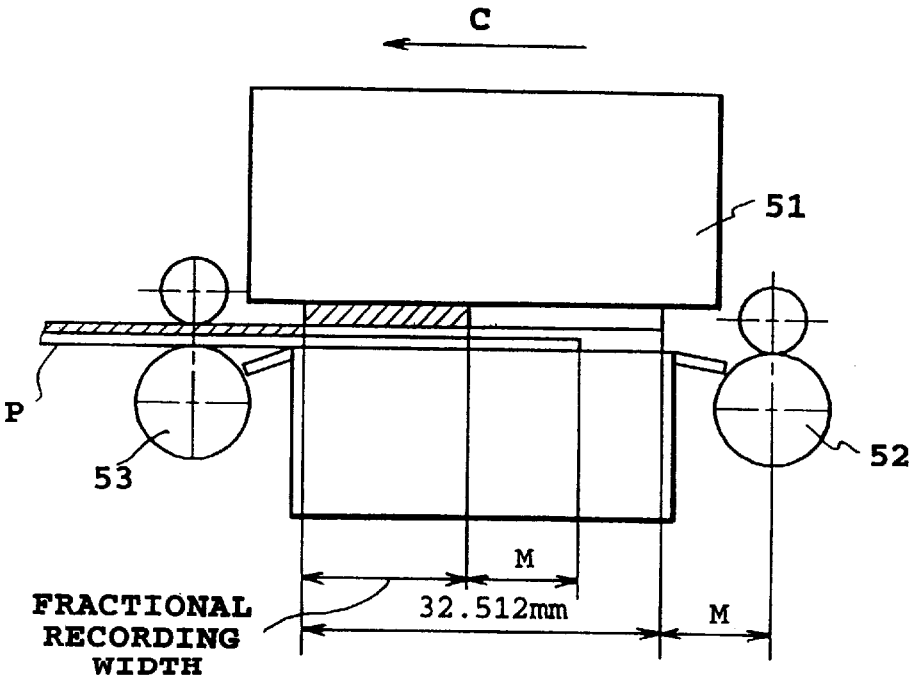
FIG.21 (PRIOR ART)
FIG. 21 is a schematic view for explaining operation when fractional recording is made by a prior art printing apparatus.
Figure 22:
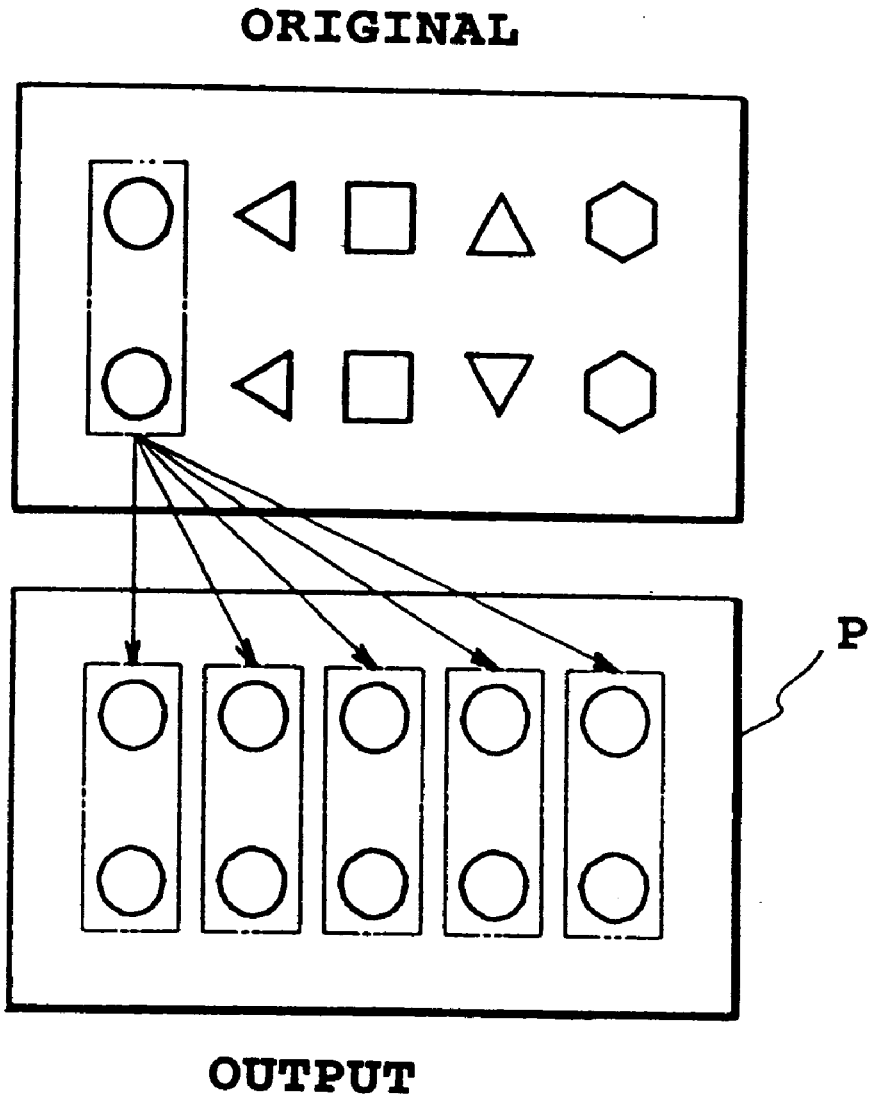
FIG. 22 (PRIOR ART)
FIG. 22 is a schematic view for explaining operation when a prior art printing apparatus makes an image repeat operation.
Figure 23A:
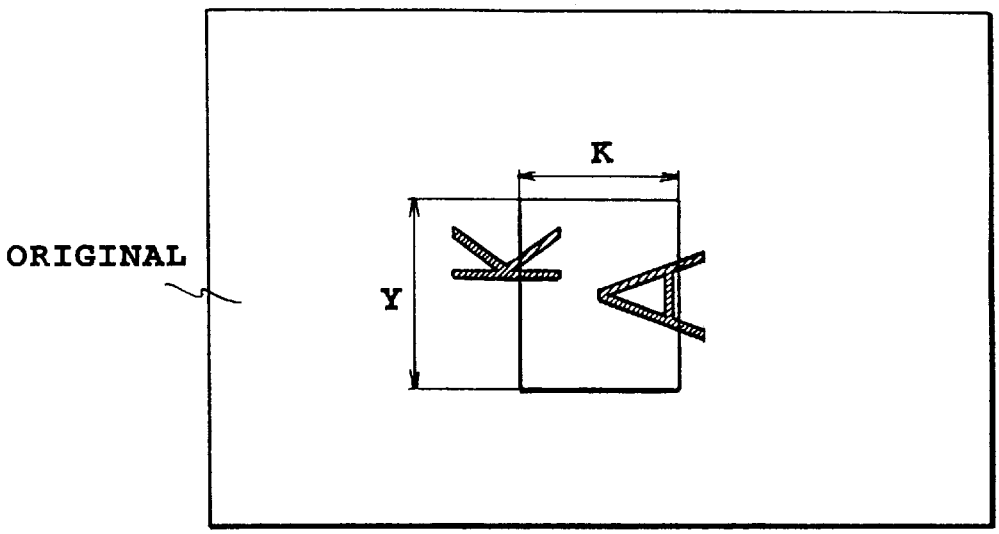
FIG.23A (PRIOR ART)
FIGS. 23A and 23B are schematic views for explaining operation when a prior art printing apparatus makes an image repeat operation.
Figure 23B:
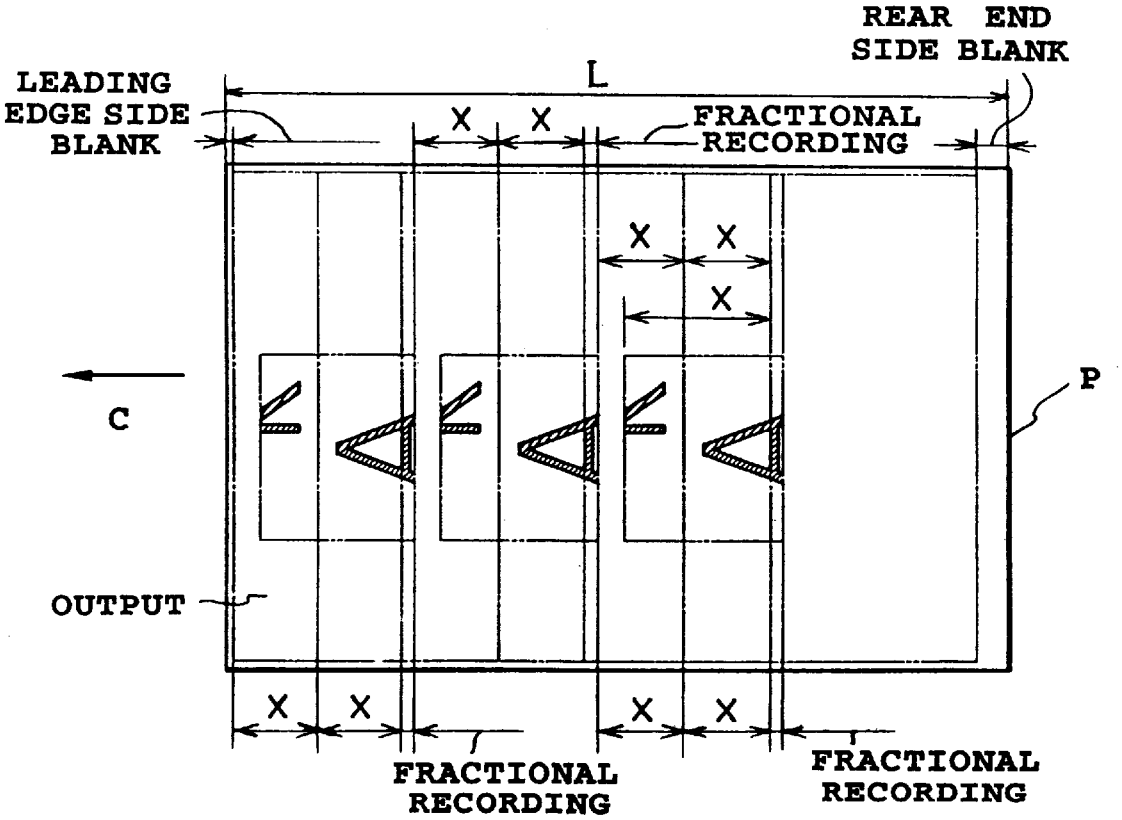
FIG.23B (PRIOR ART)

Next, the second specified image area is read, and also a distance d2 of the second specified image area is previously calculated using the above procedure based upon relationships illustrated FIGS. 12 and 13. Then, as shown in FIG. 15, after the end of the downstream side of the CCD sensor 19 is returned to a position corresponding to the position of the distance d2 from the leading edge of the second specified image area, scanning is started. On the other band, in the image formation unit, with the printing medium 9 at the same position as the above, printing is performed using only the upstream side of ink ejection ports corresponding to the distance d2. Thereafter, if coordinates of the read image on the original 10 are known and print coordinates of the image on 10 the printing medium 9 are known, an image can be formed by repeating the same procedures.

The above is the description of the image repeat mode. Also in the case here the image synthesis mode as shown in FIG. 10 is carried out, by specifying the reading image on each object 10 and the printing position on the printing medium 9, the printing medium 9 can be fed in the same method to perform printing by replacing the reading image during image formation.

With the above described method, also when the image repeat mode is carried out, it is possible to maintain the feeding amount of the printing medium 9 always in a constant value from printing the top line to the completion of printing the last line. Therefore, it is not required to make fractional recording for the number of reading times as used in the prior art, thereby achieving printing of high quality.

Third Embodiment

A third embodiment for attaining a similar object will be described.

Since the present embodiment is similar in construction to the above described first embodiment, similar reference symbols are used in the description. In the present embodiment, as in the previous embodiment, the circumferential length of the feeding roller 1 is set nearly equal to the maximum printing width X of the print head 13. Specifically, for the maximum printing width X of 32.512 mm, the diameter of the feeding roller 1 is 10.349 mm. However, in machining the roller, generation of an error in the diameter is unavoidable. For example, if the diameter is larger by 10 $\mu$m, the distance of feeding the printing medium 9 by 1 turn of the feeding roller 1 is 32.543 $\mu$m, with an error of ±32 $\mu$m compared with the correct distance of 32.512 mm. This is a sufficiently visible defect as a stripe of the image which is described above.

In the present embodiment, the feeding amount of the printing medium 9 when the feeding roller is rotated by 1 turn is previously measured to adjust the drive pulse of the motor 6 (FIG. 1) during printing medium feeding. As described above, since the pulse motor 6 for driving the feeding roller 1 has a resolution of 13 $\mu$m/pulse (32.512 mm by 2400 pulses), for example, when the feeding amount is about 30 $\mu$m greater, the number of pulses applied to the motor 6 may be reduced by 2 pulses. This decreases the feeding error from 30 $\mu$m to below 10 $\mu$m, thereby eliminating visible stripes from the image. Since, in the present embodiment, the rotation amount of the feeding roller 1 during printing medium feeding is always constant after printing the top line to the completion of printing the last line, correction of a single type of pulses is sufficient.

When the feeding roller 1 which should originally have made 1 turn by 2600 pulses is corrected by the number of drive pulses for the diameter error, strictly the roller phase is successively shifted when every one line printing. However, even with a correction of 4 pulses is made, the shift amount is $(4/2600)\times360=0.55$ degree per line, which generates almost no influence of deviation.

The present invention achieves distinct effect when applied to a recording head or a recording apparatus which has means for generating thermal energy such as electrothermal transducers or laser light, and which causes changes in ink by the thermal energy so as to eject ink. This is because such a system can achieve a high density and high resolution recording.

A typical structure and operational principle thereof is disclosed in U.S. Pat. Nos. 4,723,129 and 4,740,796, and it is preferable to use this basic principle to implement such a system. Although this system can be applied either to on-demand type or continuous type ink jet recording systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy corresponding to recording information; second, the thermal energy induces sudden temperature rise that exceeds the nucleate boiling point so as to cause film boiling on heating portions of the recording head; and third, bubbles are grown in the liquid (ink) corresponding to the drive signals. By using the growth and collapse of the bubbles, ink is expelled from at least one of the ink ejection orifices of the head to form one or more ink drops. A drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better recording.

U.S. Pat. Nos. 4,558,333 and 4,459,600 disclose the following structure of a recording head, which is incorporated to the present invention this structure includes heating portions disposed on bent portions in addition to a combination of the ejection orifices, liquid passages and the electrothermal transducers disclosed in the above patents. Moreover, the present invention can be applied to structures disclosed in Japanese Patent Application Laying-open Nos. 123670/1984 and 138461/1984 in order to achieve similar effects. The former discloses a structure in which a slit common to all the electrothermal transducers is used as ejection orifices of the electrothermal transducers, and the latter discloses a structure in which openings for absorbing pressure waves caused by thermal energy are formed corresponding to the ejection orifices. Thus, irrespective of the type of the recording head, the present invention can achieve recording positively and effectively.

The present invention can be also applied to a so-called full-line type recording head whose length equals the maximum length across a recording medium. Such a recording head may consists of a plurality of recording heads combined together, or one integrally arranged recording head.

In addition, the present invention can be applied to various serial type recording heads: a recording head fixed to the main assembly of a recording apparatus; a conveniently replaceable chip type recording head which, when loaded on the main assembly of a recording apparatus, is electrically connected to the assembly, and is supplied with ink therefrom; and a cartridge type recording head integrally including an ink reservoir.

It is further preferable to add a recovery system, or a preliminary auxiliary system for a recording head as a constituent of the recording apparatus because they serve to make the effect of the present invention more reliable. Examples of the recovery system are a capping means and a cleaning for the recording head, and a pressure or suction means for the recording head. Examples of the preliminary auxiliary system are a preliminary heating means utilizing electrothermal transducers or a combination of other heater elements and the electrothermal transducers, and a means for carrying out preliminary ejection of ink independently of the ejection for recording. These systems are effective for reliable recording.

The number and type of recording heads to be mounted on a recording apparatus can be also changed. For example, only one recording head corresponding to a single color ink, or a plurality of recording heads corresponding to a plurality of inks different in color or concentration can be used. In other words,the present invention can be effectively applied to an apparatus having at least one of the monochromatic, multi-color and full-color modes. Here, the monochromatic mode performs recording by using only one major color such as black. The multi-color mode carries out recording by using different color inks, and the full-color mode performs recording by color mixing.

Furthermore, although the above-described embodiments use liquid ink, inks that are liquid when the recording signal is applied can be used: for example, inks can be employed that solidify at a temperature lower than room temperature and are softened or liquefied at room temperature. This is because in the ink jet system, the ink is generally temperature adjusted in a range of 30° C.–70° C. so that the viscosity of the ink is maintained at such a value that the ink can be ejected reliably.

In addition, the present invention can be applied to such apparatus where the ink is liquefied just before ejection by the thermal energy as follows so that the ink is expelled from the orifices in the liquid state, and then begins to solidify on hitting the recording medium, thereby preventing the ink evaporation: the ink is transformed from solid to liquid state by positively utilizing the thermal energy which would otherwise cause the temperature rise; or the ink, which is dry when left in air, is liquefied in response to the thermal energy of the recording signal. In such cases, the ink may be retained in recesses or throughholes formed in a porous sheet as liquid or solid substances so that the ink faces the electrothermal transducers as described in Japanese Patent Application Laying-open Nos. 56847/1979 or 71260/1985. The present invention is most effective when it uses the film boiling phenomenon to expel the ink.

Furthermore, the ink jet recording apparatus of the present invention can be employed not only as an image output terminal of an information processing device such as a computer, but also as an output device of a copying machine including a reader, and as an output device of a facsimile apparatus having a transmission and receiving function.

The present invention has been described in detail with respect to various embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. A printing method using a print head including a plurality of printing elements to print an image on a printing medium by repeatedly effecting a printing operation for printing said image on said printing medium by one scanning of said print head in a main scanning direction, and a feeding operation for feeding said printing medium in a sub scanning direction substantially perpendicular to said main scanning direction, said method comprising:

a first scanning step of printing said image on said printing medium using a specific number of printing elements located at an upstream side with respect to the sub scanning direction among said plurality of printing elements when a first printing of said printing operation is performed, said specific number of printing elements being determined depending upon a residual length obtained by dividing a length of said image printed on said printing medium with respect to the sub scanning direction by a printing width printed by said plurality of printing elements with respect to the sub scanning direction;

a first feeding step of feeding said printing medium in an amount corresponding to an arrangement length of said plurality of printing elements with respect to the sub scanning direction after said first scanning step; and a printing step of printing said image on said printing medium by repeating said printing operation using said plurality of printing elements and said feeding operation for feeding said printing medium in the amount corresponding to the arrangement length of said plurality of printing elements after said first feeding step, wherein said printing medium is fed intermittently in an equal amount during feeding operations after printing said image in the first line on said printing medium until completion of printing of said image of the last line at the upstream side with respect to the sub scanning direction.

2. The printing method as claimed in claim 1, wherein when a plurality of images are printed on said printing medium by shifting in the sub scanning direction, for each of said plurality of images, the image portion of the first line is formed into a printable image by said specific number of printing elements.

3. The printing method as claimed in claim 1, wherein feeding of said printing medium is carried out by using a feeding roller pressed onto said printing medium and having a circumferential length nearly equal to said intermittent feeding amount.

4. The printing method as claimed in claim 3, wherein a rotation amount of said feeding roller is varied and stored according to a feeding amount of said printing medium per 1 turn of said feeding roller.

5. The printing method as claimed in claim 3, wherein prior to printing said image on said printing medium, a feeding amount of said printing medium per 1 turn of said feeding roller is previously measured, and said feeding roller is drive controlled according to the result of the measurement.

6. A printing apparatus using a print head including a plurality of printing elements to print an image on a printing medium, said printing apparatus having main scanning means for scanning said print head in a main scanning direction and feeding means for feeding said printing medium in a sub scanning direction substantially perpendicular to said main scanning direction and relative to said print head to print said image on said printing medium by repeatedly printing one line during a scanning operation in said main scanning direction as well as feeding said printing medium in the sub scanning direction, said apparatus comprising:

setting means for setting said image printed in a first line so as to be formed into a printable image by a specific number of printing elements located at an upstream side with respect to the sub scanning direction among said plurality of printing elements, the specific number of printing elements being determined depending upon a residual length obtained by dividing a length of said image printed on said printing medium with respect to the sub scanning direction by a printing width printed by said plurality of printing elements with respect to the sub scanning direction; and control means for controlling printing of said image set by said setting means in the first line of said printing medium, wherein said control means controls said main scanning means and said feeding means and performs printing of a line or lines following said first line of said printing medium by repeating a printing operation for a region corresponding to said printing elements of said print head, and a feeding operation by said feeding means, and wherein said feeding means feeds said printing medium intermittently in an equal amount during feeding operations after printing said image in the first line on said printing medium until completion of printing of said image of the last line at the upstream side with respect to the sub scanning direction.

7. The printing apparatus as claimed in claim 6, wherein when a plurality of images are printed on said printing medium by shifting in the sub scanning direction, with respect to each of said plurality of images, said setting means sets the image portion of the first line to be formed into a printable image by said specific number of printing elements at the upstream side with respect to the sub scanning direction.

8. The printing apparatus as claimed in claim 6, wherein said feeding means comprises a feeding roller pressed onto said printing medium and having a circumferential length nearly equal to said intermittent feeding amount.

9. The printing apparatus as claimed in claim 8, comprising a pulse motor as a drive source of said feeding roller.

10. The printing apparatus as claimed in claim 9, wherein the number of pulses outputted to said motor is varied and stored according to the feeding amount of said printing medium when said feeding roller is rotated by 1 turn.

11. The printing apparatus as claimed in claim 8, wherein said feeding means drive controls said feeding roller according to the result of measurement of feeding amount of said printing medium by one turn of said feeding roller.

12. The printing apparatus as claimed in claim 8, wherein said feeding means comprises a pulse motor as a drive source being drive controlled according to the circumferential length of said feeding roller.

13. The printing apparatus as claimed in claim 6, wherein said feeding means comprises a drive pulley connected directly to said feeding roller, a rotation motor as a drive source of said feeding roller, a motor pulley connected directly to said rotation motor, and an endless body for mechanical power transmission between said drive pulley and said motor pulley;

wherein a ratio of circumferential length of said drive pulley and said motor pulley is an inter ratio.

14. The printing apparatus as claimed in claim 6, further comprising a reading unit for reading an original image formed on an original as an image to be printed on said printing medium;

wherein said reading unit comprises a reading sensor for reading while scanning the original image corresponding to an image of one line printed on said printing medium.

15. The printing apparatus as claimed in claim 14, wherein said reading unit comprises said reading sensor movable in the main scanning direction and the sub scanning direction, transverse to each other, and an operation of reading said original image in an amount of one line by moving said reading sensor in said main scanning direction and an operation of moving said reading sensor in said sub-scanning direction by the reading width of the one line are repeated, thereby reading said original image line by line.

16. The printing apparatus as claimed in claim 15, wherein said reading sensor is provided with a plurality of reading elements, said reading unit comprises setting means for setting a first line at the upstream side with respect to said sub scanning direction of said original image to be formed into a printable image by a specific number of said printing elements located at the downstream side with respect to said sub scanning direction among said plurality of printing elements.

17. The printing apparatus as claimed in claim 14, wherein said reading unit comprises means for repeatedly outputting said original image formed on an original as an image printed on said printing medium.

18. The printing apparatus as claimed in claim 14, wherein said reading unit comprises means for synthesizing original images formed on a plurality of originals to be outputted as an image printed on said printing medium.

19. The printing apparatus as claimed in claim 6, wherein said printing elements of said print head have ink ejection ports for ejecting inks.

20. The printing apparatus as claimed in claim 19, wherein said printing elements of said print head have an electrothermal conversion element for generating a thermal energy utilized for ejecting the inks from said ink ejection ports.

* * * * *

UNITED STATES PATENT AND TRADEMARK OFFICE

CERTIFICATE OF CORRECTION

PATENT NO. : 6,217,143 B1
DATED : April 17, 2001
INVENTOR(S) : Munakata et al.

It is certified that error appears in the above-identified patent and that said Letters Patent is hereby corrected as shown below:

Title page,
Item [*], Notice: the following should be inserted:
-- This patent issued on a continued prosecution application filed under 37 CFR 1.53(d), and is subject to the twenty year patent term provisions of 35 U.S.C. 154(a)(2). --.

Column 1,
Line 31, “some of” should read -- some --.
Line 37, “is” (second occurrence) should read -- be --.
Line 51, “becomes in” should be deleted.
Line 66, “is” should read -- be --.

Column 2,
Line 21, “movments” should read -- movements --.
Line 26, “herein” should read -- wherein --.

Column 3,
Line 42, “above described” should read -- above-described --.
Line 61, “Shown” should read -- shown --.
Line 63, “as” should read -- as shown --.

Column 4,
Line 16, “unit” should read -- unit. --.
Line 33, “maxim” should read -- maximum --.

Column 5,
Line 14, “width x” should read -- width X --.

Column 6,
Line 4, “”intermittedly” should read -- intermittently --.
Line 33, “intensive” should read -- inexpensive --.

Column 7,
Line 49, “cross sectional” should read -- cross-sectional --.

Column 8,
Line 62, “distance m” should read -- distance M --.

UNITED STATES PATENT AND TRADEMARK OFFICE

CERTIFICATE OF CORRECTION

PATENT NO. : 6,217,143 B1
DATED : April 17, 2001
INVENTOR(S) : Munakata et al.

It is certified that error appears in the above-identified patent and that said Letters Patent is hereby corrected as shown below:

Column 9,
Line 17, “fed” should read -- fed in --.
Line 66, “maxim,” should read -- maximum, --.

Column 10,
Line 44, “cross sectional” should read -- cross-sectional --.

Column 11,
Line 37, “stream” should read -- downstream --.
Line 44, “image.” should read -- images. --.

Column 12,
Line 10, “limit” should read -- unit --.
Line 27, “ports” should read -- port --.
Line 32, “perform” should read -- performs --.
Line 59, “illustrated” should read -- illustrated in --.

Column 13,
Line 2, “on 10” should read -- on --.
Line 10, “above described” should read -- above-described --.
Line 22, “above described” should read -- above-described --.
Line 34, “of” should read -- in --.
Line 55, “when” should read -- with --.
Line 56, “with” should read -- when --.

Column 14,
Line 26, “to” should read -- into -- and “invention” should read -- invention: --.
Line 44, “consists” should read -- consist --.
Line 51, “assembly,” should read -- main assembly, --.

Column 15,
Line 6, “words,the” should read -- words, the --.

Column 17,
Line 46, “pulley;” should read -- pulley, --.

UNITED STATES PATENT AND TRADEMARK OFFICE

CERTIFICATE OF CORRECTION

PATENT NO. : 6,217,143 B1
DATED : April 17, 2001
INVENTOR(S) : Munakata et al.

It is certified that error appears in the above-identified patent and that said Letters Patent is hereby corrected as shown below:

Column 18,
Line 2, “inter ratio” should read -- inter-ratio --.
Line 6, “medium;” should read -- medium, --.

Signed and Sealed this

Sixteenth Day of July, 2002

*Attest:*

*Attesting Officer*

JAMES E. ROGAN
*Director of the United States Patent and Trademark Office*